US011389707B2

(12) United States Patent
Mason et al.

(10) Patent No.: US 11,389,707 B2
(45) Date of Patent: Jul. 19, 2022

(54) SWING TRAINING ASSEMBLY FOR SWING SPORTS INCLUDING GOLF, BASEBALL, TENNIS OR HOCKEY

(71) Applicants: Bradley R. Mason, Dallas, TX (US); Jeffrey T. Mason, Valley Center, CA (US)

(72) Inventors: Bradley R. Mason, Dallas, TX (US); Jeffrey T. Mason, Valley Center, CA (US)

( * ) Notice: Subject to any disclaimer, the term of this patent is extended or adjusted under 35 U.S.C. 154(b) by 17 days.

(21) Appl. No.: 16/738,372

(22) Filed: Jan. 9, 2020

(65) Prior Publication Data

US 2020/0222779 A1 Jul. 16, 2020

Related U.S. Application Data

(60) Provisional application No. 62/889,559, filed on Aug. 20, 2019, provisional application No. 62/790,728, filed on Jan. 10, 2019.

(51) Int. Cl.

| | |
|---|---|
| ***A63B 69/00*** | (2006.01) |
| ***A63B 69/36*** | (2006.01) |
| *A63B 69/38* | (2006.01) |

(52) U.S. Cl.

CPC ..... *A63B 69/0057* (2013.01); *A63B 69/3621* (2020.08); *A63B 69/0002* (2013.01); *A63B 69/0024* (2013.01); *A63B 69/0062* (2020.08); *A63B 69/38* (2013.01); *A63B 2069/0008* (2013.01); *A63B 2210/50* (2013.01); *A63B 2225/093* (2013.01)

(58) Field of Classification Search

CPC ..... A63B 69/0057; A63B 69/3621; A63B 69/0062; A63B 69/0002; A63B 2069/0008; A63B 2210/50; A63B 69/0024; A63B 2225/093; A63B 69/38; A63B 2102/02; A63B 2102/24; A63B 2102/32; A63B 2102/18

USPC ..... 473/207, 208, 215, 216, 218, 219, 227, 473/257, 258, 261, 266, 268, 270–275; 482/92, 100–104, 125–127, 130–136

See application file for complete search history.

(56) References Cited

U.S. PATENT DOCUMENTS

| | | | | |
|---|---|---|---|---|
| 2,611,610 A | | 9/1952 | Hara | |
| 2,720,660 A | * | 10/1955 | Smith | A47G 9/10 5/636 |

(Continued)

FOREIGN PATENT DOCUMENTS

| | | |
|---|---|---|
| JP | 2004-33559 A | 2/2004 |
| KR | 2012-0052050 A | 5/2012 |

*Primary Examiner* — Nini F Legesse

(74) *Attorney, Agent, or Firm* — Rodney F. Brown

(57) ABSTRACT

A swing training assembly includes a shuttle, a shuttle travel track, a tensioner, a shuttle displacement line and a shuttle pulley. The shuttle resides in the shuttle travel track and the shuttle pulley and shuttle displacement line are adapted to linearly displace the shuttle to different shuttle positions within the shuttle travel track in response to displacement forces applied to the shuttle pulley by a user pulling on the shuttle displacement line. The tensioner provides an opposing counter-force to control the rate of shuttle displacement. The swing training assembly may also include body positioning limits to maintain proper body alignment while the user pulls on the shuttle displacement line.

17 Claims, 21 Drawing Sheets

(56) References Cited

U.S. PATENT DOCUMENTS

| | | | | | |
|---|---|---|---|---|---|
| 3,215,438 | A | * | 11/1965 | Sheldon | A63B 69/3608 473/277 |
| 3,565,444 | A | | 2/1971 | La Rocca | |
| D267,028 | S | * | 11/1982 | Spisak | D21/686 |
| 4,817,953 | A | | 4/1989 | Ponchak | |
| 4,948,142 | A | | 8/1990 | Taber | |
| D312,372 | S | * | 11/1990 | Rutherford | D6/596 |
| 5,050,885 | A | | 9/1991 | Ballard | |
| D321,760 | S | * | 11/1991 | Carney | D24/190 |
| 5,203,569 | A | | 4/1993 | Rilling | |
| 5,324,247 | A | * | 6/1994 | Lepley | A63B 23/0233 482/112 |
| 5,688,212 | A | * | 11/1997 | Walker | A63B 69/0057 473/215 |
| D387,599 | S | * | 12/1997 | Ryndak | D6/601 |
| 5,707,300 | A | | 1/1998 | May | |
| 5,762,565 | A | | 6/1998 | Milam | |
| 5,830,079 | A | | 11/1998 | Hudson | |
| 5,916,037 | A | | 6/1999 | Hill | |
| 6,093,111 | A | | 7/2000 | Senn | |
| 6,551,196 | B1 | * | 4/2003 | Kossnar | A63B 69/3608 473/216 |
| 6,575,844 | B1 | * | 6/2003 | Gray | A63B 69/3667 473/277 |
| 6,579,214 | B2 | | 6/2003 | Crump | |
| 6,843,730 | B1 | | 1/2005 | Bellagamba | |
| 7,048,638 | B2 | | 5/2006 | Novotny | |
| 7,056,224 | B1 | | 6/2006 | Keyes | |
| 7,066,828 | B2 | | 6/2006 | Lee | |
| 7,134,968 | B1 | | 11/2006 | Pryor | |
| 7,150,682 | B2 | | 12/2006 | Varner | |
| 7,591,734 | B2 | | 9/2009 | Mazzone | |
| D618,944 | S | * | 7/2010 | Rothstein | D6/601 |
| 7,762,913 | B1 | | 7/2010 | Hagen | |
| 7,914,390 | B2 | | 3/2011 | Seiter | |
| 7,980,958 | B1 | | 7/2011 | Ford | |
| 8,216,080 | B2 | | 7/2012 | Park | |
| 8,696,480 | B2 | | 4/2014 | Sasser | |
| 8,784,229 | B1 | * | 7/2014 | McCullough | A63B 69/3667 473/257 |
| 8,790,226 | B2 | * | 7/2014 | Goel | A63B 69/36 482/136 |
| D736,542 | S | * | 8/2015 | Fenton | A47C 20/02 D6/601 |
| 9,561,421 | B2 | * | 2/2017 | Hungelmann | A63B 69/36 |
| 10,022,609 | B2 | | 7/2018 | Medley | |
| 10,252,131 | B2 | * | 4/2019 | May, II | A63B 69/0057 |
| 2002/0115540 | A1 | | 8/2002 | Kim | |
| 2007/0232406 | A1 | * | 10/2007 | Grant | A63B 69/3608 473/257 |
| 2018/0043208 | A1 | * | 2/2018 | Foster | G09B 19/0038 |

* cited by examiner

SWING TRAINING ASSEMBLY FOR SWING SPORTS INCLUDING GOLF, BASEBALL, TENNIS OR HOCKEY

CROSS-REFERENCE TO RELATED APPLICATIONS

This is a non-provisional patent application claiming the priority of U.S. Provisional Patent Application No. 62/790,728 to Bradley R. Mason et. al. filed on Jan. 10, 2019 and U.S. Provisional Patent Application No. 62/889,559 to Bradley R. Mason et. al. filed on Aug. 20, 2019. U.S. Provisional Patent Application Nos. 62/790,728 and 62/889,559 are incorporated herein by reference.

BACKGROUND OF THE INVENTION

The present invention relates generally to sports training and more particularly to devices and methods used to train for swing sports such as golf, baseball, tennis or hockey.

Achieving a proper swing is critical to success in swing sports such as golf, baseball, tennis or hockey where a participant swings a handheld club, bat, racquet or stick to strike a ball or puck. An optimal swing enables the participant to more accurately place the ball or puck being struck on target and/or to hit the ball or puck farther, shorter, harder or softer depending on the particular demands of the situation when playing the sport of interest. An optimal swing requires the participant to carefully control the position and weighting of the participant's body during each stage of the swing. For example, a golf swing has multiple stages including inter alia the address, takeaway, backswing, downswing, impact and follow-through stages, each of which must be mastered in order to achieve an optimal swing.

Many participants in swing sports spend countless practice hours honing their swings in hopes of ultimately improving their performance during actual competition in the swing sport of interest. There are many training devices and methods known in the prior art that participants commonly use to aid in optimizing their swings during practice sessions for their particular swing sport. It is an object of the present invention to provide an improved swing training assembly and swing training method that assist users in optimizing their swings for swing sports.

SUMMARY OF THE INVENTION

The present invention may be characterized as a swing training assembly for swing sports. The assembly has multiple embodiments and is inter alia adaptable for indoor or outdoor use, is adaptable for permanent or removable mounting to a fixed surface, is adaptable for freestanding portability and/or is adaptable for swing training in any one of multiple swing sports such as golf, baseball, tennis, hockey or the like. The present invention may be alternately characterized as a method for swing training.

One embodiment of the present invention is a swing training assembly comprising a shuttle, a shuttle travel track, a shuttle guide, a support, a tensioner, a shuttle displacement line and a shuttle pulley. The shuttle travel track is adapted to guide linear displacement of the shuttle within the shuttle travel track. The shuttle has a shuttle position within the shuttle travel track that varies as a function of linear displacement therein. The shuttle guide has a horizontal orientation, a proximal guide end, a distal guide end and an open interior housing the shuttle travel track. The support has a vertical orientation, a lower support end and an upper support end attached to the proximal guide end at a guide support attachment point. The support is adapted to maintain the shuttle guide in the horizontal orientation. The tensioner has an upper tensioner end, a lower tensioner end and a tensioner length varying as a function of the shuttle position. An upper tensioner coupler couples the upper tensioner end with the shuttle and a lower tensioner coupler couples the lower tensioner end with the support between the upper and lower support ends, such that the tensioner extends between the support and the shuttle in a diagonal orientation. The shuttle displacement line has a proximal line end, a distal line end and follows a line pathway between the proximal and distal line ends. A line anchor positioned proximal to the upper support end and the proximal guide end anchors the proximal line end to it. The shuttle pulley is attached to the shuttle and is linearly displaced with linear displacement of the shuttle. The shuttle pulley engages the shuttle displacement line in the line pathway. The shuttle pulley and shuttle displacement line are adapted to linearly displace the shuttle within the shuttle travel track when a shuttle displacement force is applied to the shuttle pulley via the distal line end in a displacement force direction against a shuttle displacement counter-force provided by the tensioner in a displacement counter-force direction.

The tensioner defines one side of a right triangle. A guide segment extending from the guide support attachment point to the shuttle position and having a guide segment length defines another side of a right triangle. A support segment extending from the lower tensioner coupler to the guide support attachment point and having a support segment length equal to a linear distance between the shuttle position and the guide support attachment point defines the third side of the right triangle. The support segment length is fixed while the tensioner, which is the hypotenuse of the right triangle, has a length that varies in inverse relation to the guide segment length.

The swing training assembly may include additional pulleys. When the shuttle pulley is a first shuttle pulley, the swing training assembly may also have a second shuttle pulley and a guide pulley. The second shuttle pulley is attached to the shuttle, is linearly displaced with linear displacement of the shuttle and engages the shuttle displacement line in the line pathway. The guide pulley is fixed in the shuttle guide more proximal to the guide support attachment point than the first and second shuttle pulleys and engages the shuttle displacement line in the line pathway. The first and second shuttle pulleys and the guide pulley make up a line guide giving the line pathway a zigzag pattern.

The swing training assembly has a maximum counter-force position and a minimum counter-force position. The swing training assembly is in the maximum counter-force position when a segment of the shuttle displacement line between the shuttle pulley and the distal line end is at a minimum length and is in the minimum counter-force position when the segment of the shuttle displacement line between the shuttle pulley and the distal line end is at a maximum length. Thus, the shuttle displacement counter-force is preferably greater when the shuttle position is more distal from the guide support attachment point and the shuttle displacement counter-force is less when the shuttle position is more proximal to the guide support attachment point.

Another embodiment of the present invention is a swing training assembly comprising a posterior limit, a trail hip limit and a lead hip limit. The posterior limit has a trail side and a lead side adjacent to the trail side. The trail side has a trail buttock contact surface and the lead side has a lead buttock contact surface, both of which are planar. The trail hip limit has a trail hip contact surface with a planar configuration. The trail hip limit is selectively and releasably mounted on the trail buttock contact surface with the trail hip contact surface perpendicular thereto. The lead hip limit has a lead hip contact surface with a planar configuration. The lead hip limit is selectively and releasably mounted on the lead buttock contact surface with the lead hip contact surface perpendicular thereto.

The trail and lead hip limits may be dimensioned and configured in correspondence with one another. The swing training assembly may further comprise a lead shoulder limit abutting the lead buttock contact surface above the lead hip limit and having a lead shoulder contact surface with a planar configuration. The lead shoulder limit may be selectively and releasably mounted on the lead hip limit. The lead hip contact surface and the lead shoulder contact surface may be canted toward the trail hip contact surface. In other alternatives, the lead shoulder limit is mounted on the posterior limit and has a rotatable member extending from the posterior limit in a substantially perpendicular orientation relative to the posterior limit when the swing training assembly is in a set-up condition. The rotatable member is rotationally displaceable from the substantially perpendicular orientation, but is laterally linearly fixed relative to the posterior limit during use of the swing training assembly.

Another embodiment of the present invention is a swing training assembly comprising a posterior limit, a trail hip limit, a lead hip limit, a shuttle, a shuttle travel track, a shuttle guide, a support, a tensioner, a shuttle displacement line and a shuttle pulley. In one alternative the shuttle guide is positioned above the posterior limit in substantially coplanar alignment therewith. In another alternative the shuttle guide, the posterior limit, the tensioner and the support are all in substantially coplanar alignment with one another. In still another alternative the swing training assembly further comprises a stand that is free-standing and the posterior limit and the support are mounted on the stand.

Another embodiment of the present invention is a swing training assembly comprising a lead shoulder limit mount adaptable for mounting on a surface and a lead shoulder limit rotatably attached to the lead shoulder limit mount. The lead shoulder limit has a rotatable member extending from the lead shoulder limit mount and is rotationally displaceable relative to the lead shoulder limit mount in a vertically-oriented arc, but the lead shoulder limit is linearly fixed relative to the lead shoulder limit mount during use of the swing training assembly. The rotatable member may be a rearward rotatable member with the swing training assembly further comprising a forward rotatable member rotatably attached to the rearward rotatable member and rotationally displaceable relative to the rearward rotatable member and the lead shoulder limit mount in a vertically-oriented arc. The vertically-oriented arc of the rearward rotatable member may correspond to the vertically-oriented arc of the forward rotatable member.

Another embodiment of the present invention is a swing training method comprising the following steps. A user simulates a top of a golf backswing by gripping a handle that simulates a golf club handle at an upper backswing position. The user starts a simulated downswing by applying a downward pulling force to the handle at the upper backswing position against a resistance counter-force. The user continues the simulated downswing by continuing to apply the downward pulling force to the handle against the resistance counter-force to downwardly displace the handle to an intermediate downswing position lower than the upper backswing position. The user ends the simulated downswing when the handle reaches a predetermined downswing end position lower than the intermediate downswing position. The resistance counter-force is at a peak when the simulated downswing is started and the resistance counter-force progressively diminishes as the predetermined downswing end position is approached.

Another embodiment of the present invention is a swing training method performed while swinging a golf club. A user performing the method has feet, hands, a trail buttock, a lead buttock, a trail hip, a lead hip, a lead shoulder and a lead arm. The user addresses a real golf ball or a phantom golf ball while the feet are planted on a horizontal surface, the trail buttock is in contact with a trail buttock contact surface on a posterior limit aligned substantially perpendicular to the horizontal surface and the trail hip is in contact with a trail hip limit mounted on the posterior limit and aligned substantially perpendicular to the posterior limit and the lead hip is free from contact with a lead hip limit mounted on the posterior limit and is aligned substantially perpendicular to the posterior limit.

The user performs a backswing stage of a golf swing, thereby raising the hands to a height above the trail shoulder while the trail hip remains in contact with the trail hip limit, the trail buttock remains in contact with the trail buttock contact surface and the lead hip remains free from contact with the lead hip limit. The user performs a downswing stage of the golf swing, thereby lowering the hands in a downward arc to a height below the trail shoulder while drawing the lead hip into contact with the lead hip limit, drawing the lead buttock into contact with the lead buttock contact surface, drawing the trail hip away from contact with the trail hip limit and drawing the trail buttock away from contact with the trail buttock contact surface.

In one alternative the method further comprises addressing the real or phantom golf ball while the lead shoulder is free from contact with a lead shoulder limit aligned substantially perpendicular to the posterior limit, performing the backswing stage while the lead shoulder remains free from contact with the lead shoulder limit and performing the downswing stage while drawing the lead shoulder near or into light contact with the lead shoulder limit. In another alternative the method further comprises initiating a follow-through stage of the golf swing having a follow-through swing path, thereby drawing the hands in an upward arc and the lead shoulder into full contact with the lead shoulder limit without laterally linearly displacing the lead shoulder limit. The user continues the follow-through stage of the golf swing to an intermediate point of the follow-through stage, thereby contacting the lead shoulder limit with the lead arm and initiating rotational displacement of the lead shoulder limit in an upward arc away from the follow-through swing path. The user completes the follow-through stage of the golf swing, thereby raising the hands to a height above the lead shoulder while the lead arm rotationally displaces the lead shoulder limit out of the follow-through swing path and free from contact with the golf club and the user.

The invention will be further understood from the drawings and the following more detailed description.

BRIEF DESCRIPTION OF THE SEVERAL VIEWS OF THE DRAWINGS

The below-listed drawing figures illustrate one or more embodiments of the present invention by way of example and not by way of limitation. Common reference characters may be used among the different drawing figures to indicate the same or similar structural elements.

DETAILED DESCRIPTION OF PREFERRED EMBODIMENTS OF A SWING TRAINING ASSEMBLY

Figure 1:
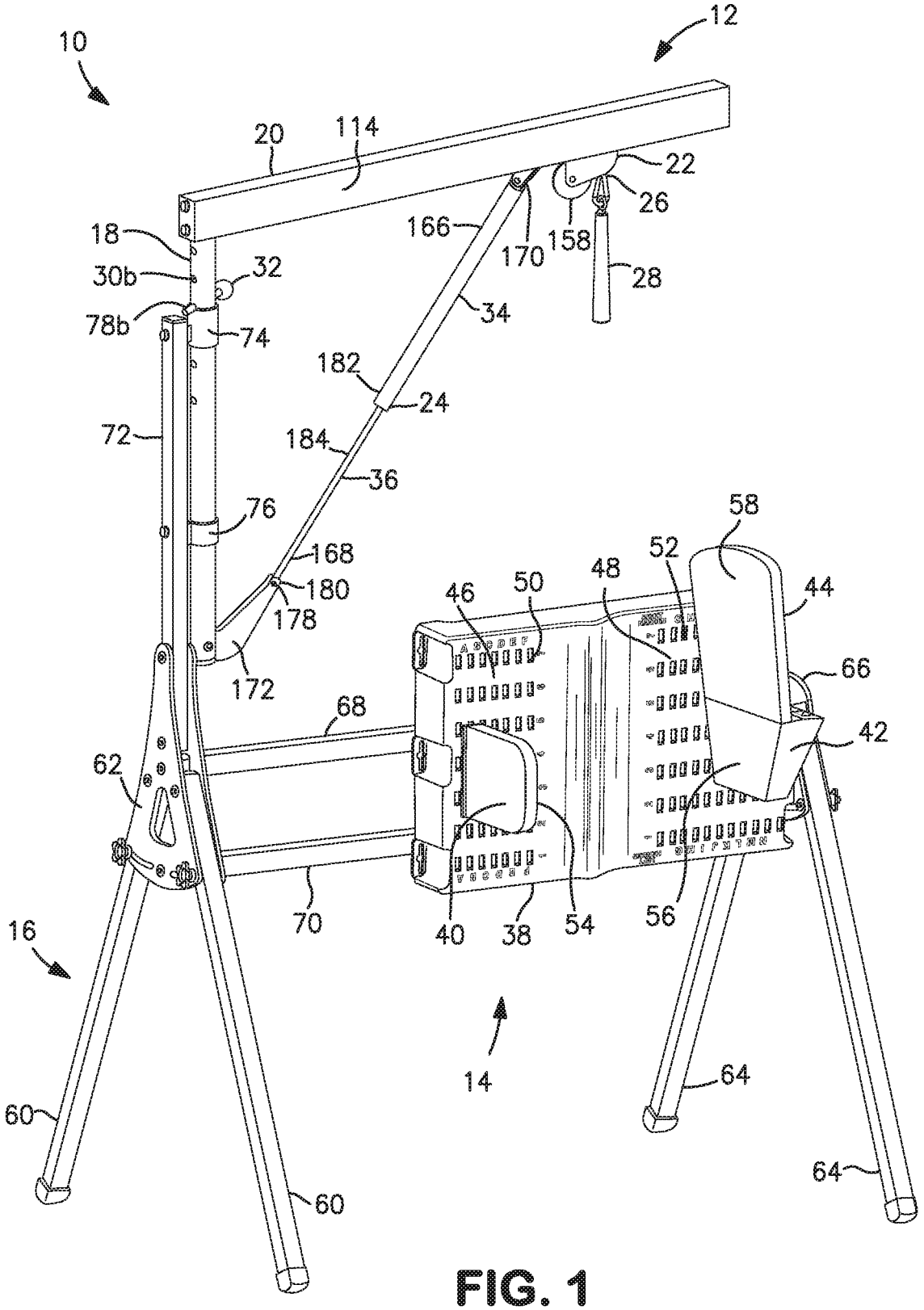
FIG. 1 is a perspective view of an embodiment of a swing training assembly adapted for a simulated golf swing, wherein the swing training assembly includes a body positioning unit and a swing resistance unit mounted on an assembly stand.

An embodiment of a swing training assembly generally designated 10 in FIG. 1 is shown in a set-up condition that is ready for use, but is not actually in use. The present embodiment of the swing training assembly 10 is adapted for swing training in the sport of golf and is specifically adapted for use by a golfer with a right-handed golf swing, which is typically employed when the right side of the body is the golfer's dominant side. In the case of a right-handed golf swing, the term "trail" refers to the right side of the golfer's body and the term "lead" refers to the left side of the golfer's body. Thus, the trail hip is the right hip and the lead hip is the left hip for a right-handed golf swing. Although not shown, the swing training assembly 10 can alternatively be adapted for use with a left-handed golf swing. This swing training assembly 10 is typically adapted for a left-handed golf swing when the left side is the golfer's dominant side. In the case of a left-handed golf swing, the term "trail" refers to the left side of the golfer's body and the term "lead" refers to the right side of the golfer's body. Thus, the trail hip is the left hip and the lead hip is the right hip for a left-handed golf swing. The term "trail" is also used hereafter with reference to structural elements of the swing training assembly 10 that are intended to engage the golfer's trail side or are more proximal to the golfer's trail side when using the swing training assembly 10. The term "lead" is also used hereafter with reference to structural elements of the swing training assembly 10 that are intended to engage the golfer's lead side or are more proximal to the golfer's lead side when using the swing training assembly 10.

Certain structural elements of the swing training assembly 10 are characterized hereafter as having a "vertical orientation" or being "vertically-oriented" or as having a "horizontal orientation" or being "horizontally-oriented". The terms "vertical orientation" or "vertically-oriented" (i.e., perpendicular to the plane of the horizon) and "horizontal orientation" or "horizontally-oriented" (i.e. parallel to the plane of the horizon) refer to the primary spatial orientation of the referenced structural element when the swing training assembly 10 is in the set-up condition. The terms "perpendicular orientation" or "perpendicularly-oriented" and "parallel orientation" or "parallely-oriented" as used hereafter refer to the alignment of two given structural elements of the swing training assembly 10 relative to one another. Perpendicularly-oriented elements are aligned at a right angle to one another and parallely-oriented elements are aligned coplanar to one another and the same distance continuously between them.

Figure 2:
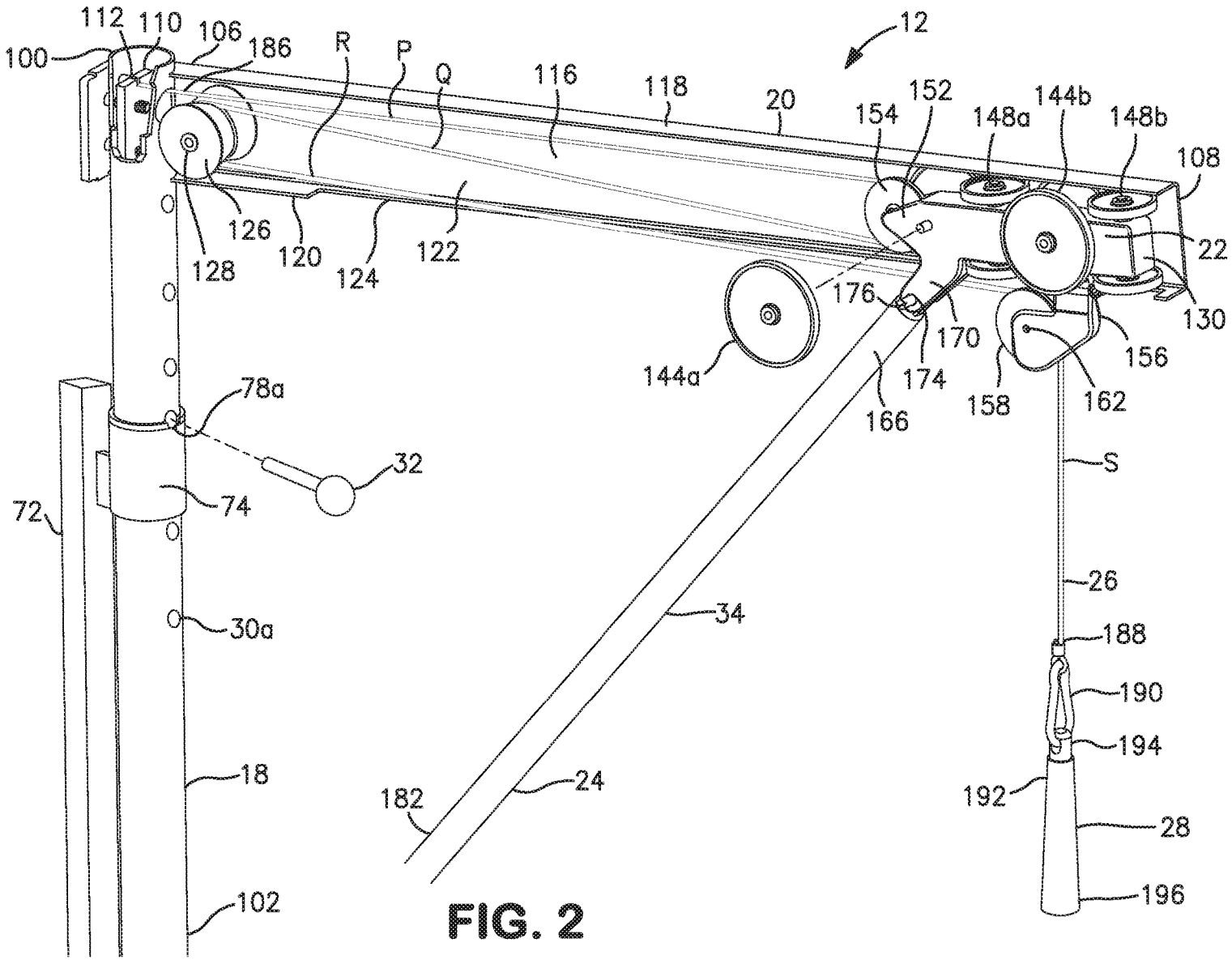
FIG. 2 is a partial perspective view of the swing resistance unit of FIG. 1 shown in a maximum counter-force position.

The swing training assembly 10 comprises a swing resistance unit 12, a body positioning unit 14 and an assembly stand 16. The assembly stand 16 provides a free-standing support base for the swing resistance and body positioning units 12, 14 and structurally interconnects the units 12, 14 to one another to facilitate their interrelated functionality. The swing resistance unit 12 includes a mast 18, a shuttle guide 20, a shuttle 22, a tensioner 24, a shuttle displacement line 26 and a handle 28. The mast 18 and shuttle guide 20 each has a linear elongate hollow configuration. The mast 18 is preferably a cylindrically-walled tube having multiple pairs of opposing height adjustment apertures 30*a*, 30*b* (30*b* is shown in FIG. 2) formed in its cylindrical wall at spaced-apart intervals along its length. The height adjustment apertures 30*a*, 30*b* are sized to slidably receive a selectively removable stop 32 therein that is preferably configured as a pin with a knob on its end enabling the user to more readily grip the stop 32. The shuttle guide 20 is preferably configured in the shape of a right rectangular prism.

The mast 18 and shuttle guide 20 are fixably attached to one another. The term "fixably attached" as used in this context means that the mast 18 and shuttle guide 20 remain engaged in a static position relative to one another at all times during use of the swing training assembly 10. The shuttle guide 20 and shuttle 22 are sized and configured in cooperation with one another, thereby enabling the shuttle 22 to be housed within the hollow shuttle guide 20 and further permitting slidable back and forth horizontal displacement of the shuttle 22 within the shuttle guide 20. The tensioner 24 has an elongate linear configuration that extends diagonally between the mast 18 and shuttle guide 20, thereby connectively linking the mast 18 and shuttle guide 20 to one another. The tensioner 24 of the present embodiment includes a compression piston having a widened chamber 34 and a narrow rod 36 that telescopically extends into the chamber 34. The chamber 34 is pivotally connected to the shuttle 22 and the rod is pivotally connected to the mast 18. The shuttle displacement line 26 is a cord, cable, wire or the like that is relatively thin, strong, wear-resistant and pliant. In addition the shuttle displacement line 26 is preferably substantially non-stretchable. The shuttle displacement line 26 slidably engages the shuttle 22 and is rotatably connected to the handle 28.

The body positioning unit 14 includes a posterior limit 38, a trail hip limit 40, a lead hip limit 42 and a lead shoulder limit 44, each of which is configured as a panel that is constructed from a strong, rigid, durable material such as a metal, plastic, wood or combination thereof. The posterior limit 38 is vertically partitioned into a trail buttock contact surface 46 and a lead buttock contact surface 48 that intersect one another. Trail hip limit mounting apertures 50 are formed in the trail buttock contact surface 46 and lead hip limit mounting apertures 52 are formed in the lead buttock contact surface 48. The trail hip limit 40 has a trail hip contact surface 54, the lead hip limit 42 has a lead hip contact surface 56 and the lead shoulder limit 44 has a lead shoulder contact surface 58, each of which is planar and is configured to engage the respective parts of the user's body. The trail hip limit 40 and lead hip limit 42 are each separately, selectively and removably attachable to the posterior limit 38. The lead shoulder limit 44 is selectively and removably attachable to the lead hip limit 42.

The assembly stand 16 includes a pair of trail legs 60 and an associated trail leg coupler 62, a pair of lead legs 64 and an associated lead leg coupler 66, upper and lower posterior limit support members 68, 70 and a mast support member 72. The trail leg coupler 62 pivotally attaches the trail legs 60 to one another at one end while the opposite ends of the trail legs 60 remain free. The lead leg coupler 66 similarly pivotally attaches the lead legs 64 to one another at one end while the opposite ends of the lead legs 64 remains free. Each of the upper and lower posterior limit support members 68, 70 is a crossbeam extending horizontally between the pairs of trail and lead legs 60, 64 and trail and lead leg couplers 62, 66 and attaching thereto. The mast support member 72 is attached to the trail leg coupler 62 and extends vertically upward therefrom. The mast support member 72 has upper and lower mast retention rings 74, 76 affixed thereto that are sized to slidably receive the mast 18 therethrough. The upper mast retention ring 74 has a pair of opposing notches 78*a*, 78*b* formed in its upper edge that are sized to slidably receive the selectively removable stop 32 therein. The relative positional terms "upper" and "lower" as used herein refer to the relative vertical positioning of structural elements of the swing training assembly 10 with respect to one another when the swing training assembly 10 is in the set-up condition.

The trail and lead legs 60, 64, upper and lower posterior limit support members 68, 70 and mast support member 72 each preferably has a linear elongate hollow configuration. The materials of construction for the assembly stand 16 as well as for the swing resistance and body positioning units 12, 14 (excluding the shuttle displacement line 26) are preferably characterized as strong, rigid and durable and are preferably selected from such materials as metals, plastics, wood or combinations thereof.

The mast 18, trail and lead legs 60, 64 and mast support member 72 are all vertically-oriented when the swing training assembly 10 in the set-up condition. In contrast, the shuttle guide 20 and posterior limit support members 68, 70 are all horizontally-oriented and, as such, are aligned perpendicular to the vertically-oriented elements of the swing training assembly 10. In addition, the mast 18, shuttle guide 20, posterior limit 38, posterior limit support members 68, 70 and mast support member 72 are all substantially vertically coplanar with respect to one another, i.e., all reside within the same vertical plane. The term "substantially coplanar" is used in the present context to account for slight variations in alignment that are outside of a single precise vertical plane due to different thicknesses of the posterior limit 38 at the trail and lead buttock contact surfaces 46,44, respectively, and to cases where the shuttle guide 20 may be rotated about the mast 18 to a slightly forward fixed position that is out of precise vertical coplanar alignment with the posterior limit 38, posterior limit support members 68, 70 and mast support member 72.

The term "vertically-oriented" as used in the context of the lead hip and lead shoulder contact surfaces 56, 58 allows for some slight deviation from true vertical. In the present embodiment of the swing training assembly 10, the vertically-oriented lead hip and shoulder contact surfaces 56, 58 are oriented about 8° to 10° from true vertical which results in the vertically-oriented lead hip and shoulder contact surfaces 56, 58 having a slight inward cant toward the trail hip contact surface 54 as the lead hip and shoulder contact surfaces 56, 58 extend upward. In other alternate embodiments the slight inward cant of the vertically-oriented lead hip and shoulder contact surfaces 56, 58 may be somewhat greater, e.g., as much as about 15°, or may be less than 8° to 10° from true vertical. In yet another alternate embodiment, the lead hip and shoulder contact surfaces 56, 58 may be aligned precisely with true vertical.

The term "horizontally-oriented" as used in the context of the shuttle guide 20 allows for some slight deviation from true horizontal. The horizontally-oriented shuttle guide 20 of the present embodiment angles about 5° upwardly from true horizontal as the shuttle guide 20 extends away from the mast 18, thereby forming a slightly obtuse lower angle of intersection with the mast 18. In other alternate embodiments the slight upward angle of the horizontally-oriented shuttle guide 20 may be somewhat greater, e.g., wherein the slightly obtuse angle of intersection as much as about 15°. In still other alternate embodiments, the horizontally-oriented shuttle guide 20 angles about 5-15° downwardly from true horizontal as the shuttle guide 20 extends away from the mast 18, thereby forming a slightly acute lower angle of intersection with the mast 18.

Swing Resistance Unit

Figure 3:
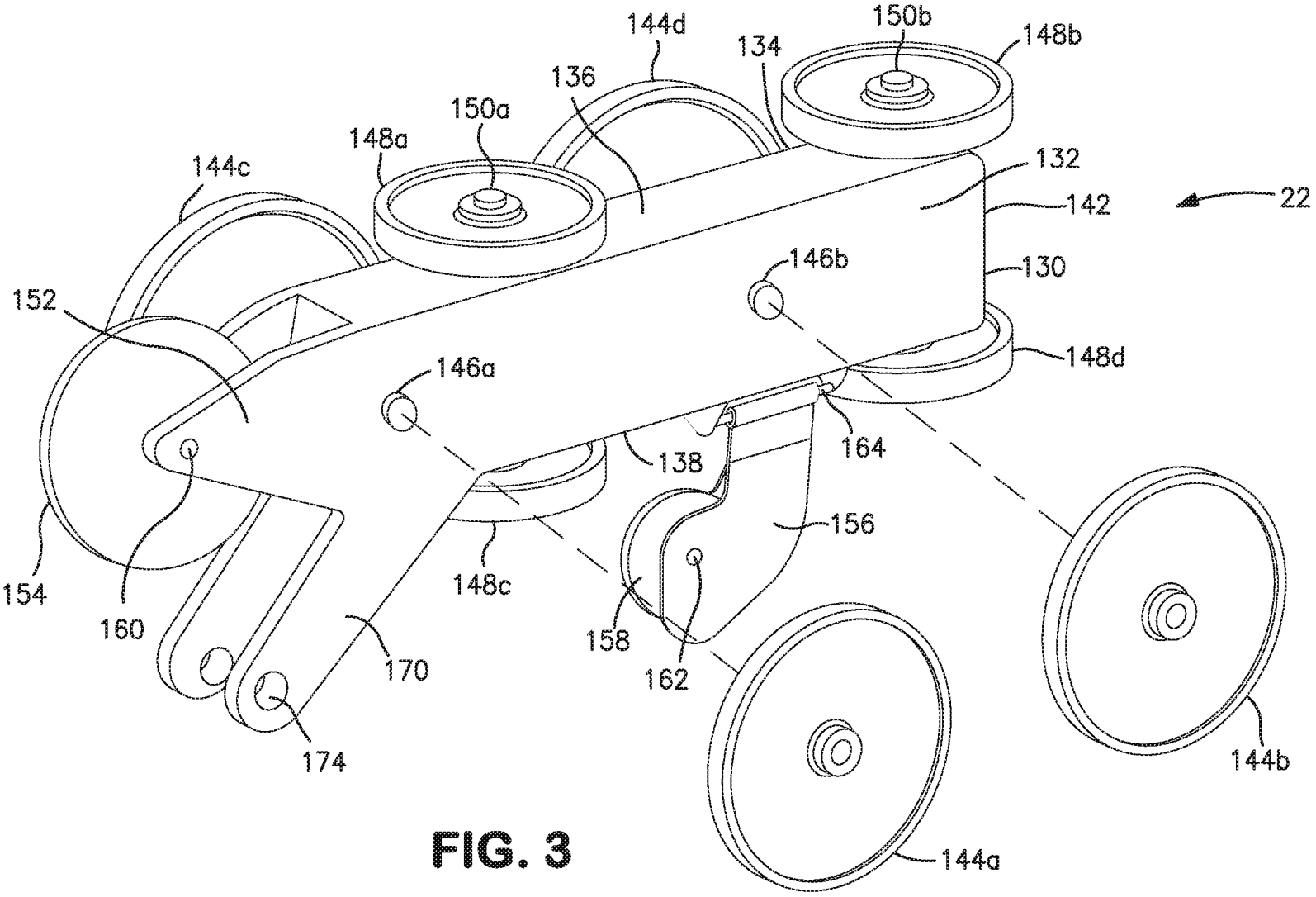
FIG. 3 is a perspective view of a shuttle included in the swing resistance unit of FIG. 2.
Figure 4:
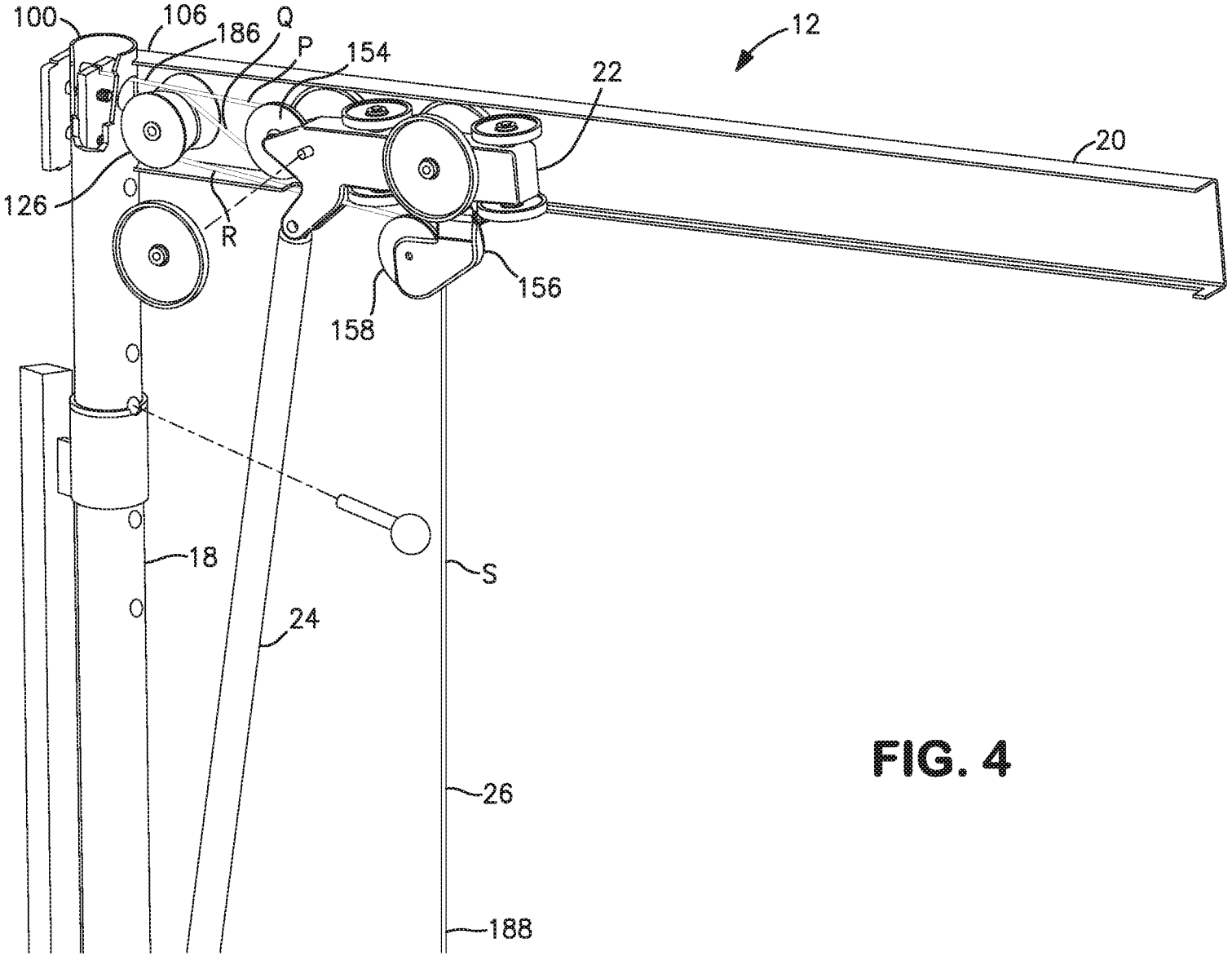
FIG. 4 is a partial perspective view of the swing resistance unit of FIG. 2, but shown in a minimum counter-force position.

Further details of the swing resistance unit 12 are described with continuing reference to FIG. 1 and additional reference to FIGS. 2-4. The mast 18 has an upper end 100 and a lower end 102 and the shuttle guide 20 has a proximal guide end 106 and a distal guide end 108. The proximal guide end 106 of the shuttle guide 20 and the upper end 100 of the mast 18 intersect one another and are fixably attached to one another at their intersection termed a guide support attachment point. As such, the mast 18 functions as a support for the shuttle guide 20. Unless stated otherwise, when the terms "proximal" and "distal" are used herein in the context of the swing resistance unit 12, the terms refer to the relative distances of given structural elements of the swing resistance unit 12 from the mast 18.

A line anchor 110, which is in the form of a rigid plate, is positioned in the interior of the upper end 100 of the mast 18 and is fixably attached thereto. The line anchor 110 has a line aperture 112 formed therethrough. Although not shown, the line anchor can alternatively be integrally formed with the tubular wall of the mast 18 or can be positioned external to the mast 18 at or near the proximal guide end 106 of the shuttle guide 20 and upper end 100 of the mast 18 where they attach to one another. In a broader sense, a suitable line anchor for the swing resistance unit 12 encompasses substantially any element that fixes, i.e., anchors, the shuttle displacement line 26 to a structure of the swing resistance unit 12 at or near the proximal guide end 106 of the shuttle guide 20.

The shuttle guide 20 has four contiguous rectangular sidewalls that are of equal length, namely, two parallel vertically-oriented sidewalls, i.e., a front sidewall 114 and an opposing rear sidewall 116, and two parallel horizontally-oriented sidewalls, i.e., an upper sidewall 118 and an opposing lower sidewall 120. As such, the front and rear sidewalls 114, 116 of the shuttle guide 20 are perpendicularly-oriented relative to the upper and lower sidewalls 118, 120. The front sidewall 114 has been omitted from the shuttle guide 20 in FIGS. 2 and 4 to more clearly show the interior of the shuttle guide 20. The inside faces of the front, rear, upper and lower sidewalls 114, 116, 118, 120 bound the hollow interior of the shuttle guide 20 and define a shuttle travel track 122. The inside faces of the upper and lower sidewalls 118, 120 are significantly narrower than those of the front and rear sidewalls 114, 116, thereby providing the shuttle travel track 122 with a rectangular cross-section. The inside faces of the front, rear, upper and lower sidewalls 114, 116, 118, 120 are all smooth continuous planar surfaces with the exception of an open longitudinal slot 124 formed through the lower sidewall 120 that extends along most of its length.

The relative positional terms "front" or "forward" and "rear" or "rearward" as used above in the context of the sidewalls 114, 116 refer to their relative horizontal positioning, wherein the outside face of the front sidewall 114 is oriented toward a golfer using the swing training assembly 10 (and is more proximal to the golfer) and the outside face of the rear sidewall 116 is oriented away from the golfer (and is more distal from the golfer). The relative positional terms "inside" or "inner" and "outside" or "outer" when used in the context of the shuttle guide 20 refer to the relative proximity of a given structural element of the shuttle guide 20 to the longitudinal axis of the shuttle guide 20, wherein an "inside" or "inner" element is more proximal to the axis than an "outside" or "outer" element. Although not shown, the shuttle guide 20 may alternatively be configured so that its hollow interior has a square cross-section or a circular cross-section and the configuration of the shuttle 22 is cooperatively adapted to these alternative configurations.

A guide pulley 126 is positioned in the interior of the shuttle guide 20 at its proximal guide end 106. A guide axle 128 is attached to the front and rear sidewalls 114, 116 of the shuttle guide 20 and the guide pulley 126 is rotatably attached to the guide axle 128 enabling the guide pulley 126 to fully and freely rotate relative to the shuttle guide 20 in a 360° radial direction about the guide axle 128. However, the guide pulley 126 is linearly fixed relative to the mast 18 and shuttle guide 20 so that the guide pulley 126 is not linearly displaceable within the shuttle travel track 122.

The shuttle 22 includes a main body 130 configured as a thin right rectangular prism having a front face 132 and an opposing rear face 134 that are bounded by opposing upper and lower edges 136, 138 and opposing proximal and distal edges 140, 142. The length of the main body 130 and correspondingly the length of the shuttle 22 are each significantly less than the length of the shuttle travel track 122 and the height of the main body 130 is less than the height of the shuttle travel track 122. Two vertically-oriented front rollers 144*a*, 144*b* are positioned adjacent to the front face 132 and two vertically-oriented rear rollers 144*c*, 144*d* are positioned adjacent to the opposing rear face 134. The front and rear rollers 144*a*, 144*c* are rotatably connected to the main body 130 by a first vertical roller axle 146*a* extending through width of the main body 130 and the front and rear rollers 144*b*, 144*d* are rotatably connected to the main body 130 by a second vertical roller axle 146*b* also extending through the main body 130. The vertically-oriented rollers 144*a*, 144*b*, 144*c*, 144*d* are all constructed and dimensioned essentially identical to one another.

Two horizontally-oriented front rollers 148*a*, 148*b* are positioned adjacent to the upper edge 136 and two horizontally-oriented rear rollers 148*c*, 148*d* are positioned adjacent to the opposing lower edge 138. The front and rear rollers 148*a*, 148*c* are rotatably connected to the main body 130 by a first horizontal roller axle 150*a* extending through the height of the main body 130 and the front and rear rollers 148*b*, 148*d* are rotatably connected to the main body 130 by a second horizontal roller axle 150*b* extending through height of the main body 130. The horizontally-oriented rollers 148*a*, 148*b*, 148*c*, 148*d* are all constructed and dimensioned essentially identical to one another. The first and second vertical roller axles 146*a*, 146*b* and first and second horizontal roller axles 150*a*, 150*b* are all perpendicularly-oriented relative to the longitudinal axis of the main body 130.

The outside diameters of the vertically-oriented rollers 144*a*, 144*b*, 144*c*, 144*d* are substantially equal to the height of the shuttle travel track 122 and the outside diameters of the horizontally-oriented rollers 148*a*, 148*b*, 148*c*, 148*d* are substantially equal to the width of the shuttle travel track 122. The term "substantially equal" as used in the present context encompasses the embodiment shown herein, wherein the outside diameters of the vertically-oriented rollers 144*a*, 144*b*, 144*c*, 144*d* are only slightly less than the height of the shuttle travel track 122 and the outside diameters of the horizontally-oriented rollers 148*a*, 148*b*, 148*c*, 148*d* are only slightly less than the width of the shuttle travel track 122. This enables the vertically-oriented rollers 144*a*, 144*b*, 144*c*, 144*d* to slidably engage the smooth inside faces of the upper and lower sidewalls 118, 120 and the horizontally-oriented rollers 148*a*, 148*b*, 148*c*, 148*d* to slidably engage the smooth inside faces of the front and rear sidewalls 114, 116 when the shuttle 22 is in the shuttle travel track 122.

The shuttle 22 is slidably displaceable back and forth within the shuttle travel track 122 in a linear horizontal direction that is parallel to the longitudinal axis of the shuttle guide 20. The shuttle travel track 122, vertically-oriented rollers 144*a*, 144*b*, 144*c*, 144*d* and horizontally-oriented rollers 148*a*, 148*b*, 148*c*, 148*d* are cooperatively constructed and dimensioned to minimize the degree of friction between the rollers and the shuttle travel track 122 when the shuttle 22 is horizontally displaced therein. The close fit of the rollers in the shuttle guide 20 minimizes vertical movement of the shuttle 22 within the shuttle guide 20. The close fit also minimizes perpendicular horizontal movement of the shuttle 22 within the shuttle guide 20 relative to the longitudinal axis of the shuttle guide 20 while freely permitting parallel horizontal movement.

The shuttle 22 includes a proximal pulley mount 152 having a proximal shuttle pulley 154 attached thereto and a lower pulley mount 156 having a lower shuttle pulley 158 attached thereto, all of which extend from the main body 130 of the shuttle 22. The proximal pulley mount 152, alternately termed a second pulley mount, is a bracket that is fixably attached to the proximal edge 140 of the main body 130 and extends in a proximal direction therefrom (i.e., toward the mast 18). The proximal shuttle pulley 154 is rotatably attached to the proximal pulley mount 152 by a proximal pulley axle 160, alternately termed a second pulley axle, that is positioned on the proximal pulley mount 152 and is perpendicularly-oriented relative to the longitudinal axis of the main body 130. The proximal shuttle pulley 154, alternately termed a second shuttle pulley, has a vertical-orientation and is fully and freely rotatable 360° about the proximal pulley axle 160. The proximal shuttle pulley 154 is retained at all times within the shuttle travel track 122 and is displaceable in the linear horizontal direction therein relative to the mast 18, but is fixed in the linear horizontal direction relative to the shuttle 22. Thus, linear horizontal travel of the proximal shuttle pulley 154 within the shuttle travel track 122 occurs simultaneously with and in response to the linear horizontal travel of the shuttle 22 within the shuttle travel track 122.

The lower pulley mount 156, alternately termed a first pulley mount, is a bracket that is pivotally attached to the lower edge 138 of the main body 130 and extends, at least in part, in a downward direction therefrom. The lower shuttle pulley 158 is rotatably attached to the lower pulley mount 156 by a lower pulley axle 162, alternately termed a first pulley axle, that is positioned on the lower pulley mount 156. The lower shuttle pulley 158, alternately termed a first shuttle pulley, is fully and freely rotatable 360° about the lower pulley axle 162. The lower shuttle pulley 158 is displaceable in the linear horizontal direction relative to the mast 18, but is fixed in the linear horizontal direction relative to the shuttle 22. Thus, linear horizontal travel of the lower shuttle pulley 158 occurs simultaneously with and in response to linear horizontal travel of the shuttle 22 within the shuttle travel track 122.

The lower pulley mount 156 is pivotally attached to the lower edge 138 by a pivot axle 164 that is positioned thereon in a parallel orientation relative to the longitudinal axis of the main body 130. The lower pulley mount 156 and lower shuttle pulley 158 extend from the lower edge 138 through the longitudinal slot 124 in the lower sidewall 120 of the shuttle guide 20 to the exterior of the shuttle guide 20. The pivot axle 164 enables radial rotation of the lower pulley mount 156 and lower shuttle pulley 158 about the pivot axle 164 in an arcuate cylindrical pathway parallel to the longitudinal axis of the main body 130. Accordingly, the lower pulley mount 156 and lower shuttle pulley 158 are capable of rotating about the pivot axle 164 in a radial forward direction away from true vertical in a range from about 0° to about 90° during use of the swing training assembly 10.

The tensioner 24 diagonally extends between a first or upper end 166 of the tensioner 24 that is coupled with the shuttle 22 and a second or lower end 168 of the tensioner 24 that is coupled with the mast 18. A first or upper tension coupler 170 is provided at the upper end 166 to effect pivotal coupling of the tensioner 24 and shuttle 22 to one another. A second or lower line tension coupler 172 is also provided at the lower end 168 to effect pivotal coupling of the tensioner 24 and mast 18 to one another. The upper tensioner coupler 170 is a bracket that is integrally formed with the proximal pulley mount 152 of the shuttle 22. As such, the upper tensioner coupler 170 is stationarily affixed the proximal edge 140 of the main body 130 and extends diagonally at a proximal downward angle of about 45° therefrom. The lower tensioner coupler 172 is a bracket that is stationarily affixed to the lower end of the mast 18 and extends diagonally at a distal upward angle of about 45° therefrom. The term "stationarily affixed" as used in the present context means that the upper tensioner coupler 170 does not move relative to the shuttle 22 and the lower tensioner coupler 172 does not move relative to the mast 18 during use of the swing training assembly 10.

The upper tensioner coupler 170 has an upper coupling aperture 174 formed therein that is sized to receive a selectively removable upper coupling pin 176. Accordingly, the upper tensioner coupler 170 enables selective uncoupling of the tensioner 24 and shuttle 22 to one another. The lower tensioner coupler 172 similarly has a lower coupling aperture 178 formed therein that is sized to receive a selectively removable lower coupling pin 180. Accordingly, the lower tensioner coupler 172 enables selective uncoupling of the tensioner 24 and mast 18 from one another.

The chamber 34 of the tensioner 24 has an upper end that is one and the same as the upper end 166 of the tensioner 24 and the chamber 34 extends diagonally downward from the upper end 166 to a lower end 182 of the chamber 34. The rod 36 has a lower end that is one and the same as the lower end 168 of the tensioner 24 and the rod 36 extends diagonally upward from the lower end 168 to an upper end 184 of the rod 36. The chamber 34 is an enclosed hollow cylinder with an opening at its lower end 182 sized to slidably receive the upper end 184 of the narrower rod 36 which enables the rod 36 to telescope into or out of the chamber 34. The overall length of the tensioner 24 varies during use of the swing training assembly 10 as an inverse function of the distance that the upper end 184 of the rod 36 extends into or out of the chamber 34. The tensioner 24 has an a maximum length when the swing training assembly 10, and more particularly the swing resistance unit 12, is in a maximum counter-force position. The tensioner also has a minimum length when the swing training assembly 10, and more particularly the swing resistance unit 12, is in a minimum counter-force position. The tensioner 24 achieves maximum length by maximally withdrawing the rod 36 out chamber 34 while still retaining the upper end 184 of the rod 36 therein. The tensioner 24 achieves minimum length by maximally inserting the rod 36 into the chamber 34 while still retaining the lower end 168 of the rod 36 external thereto.

Figure 6:
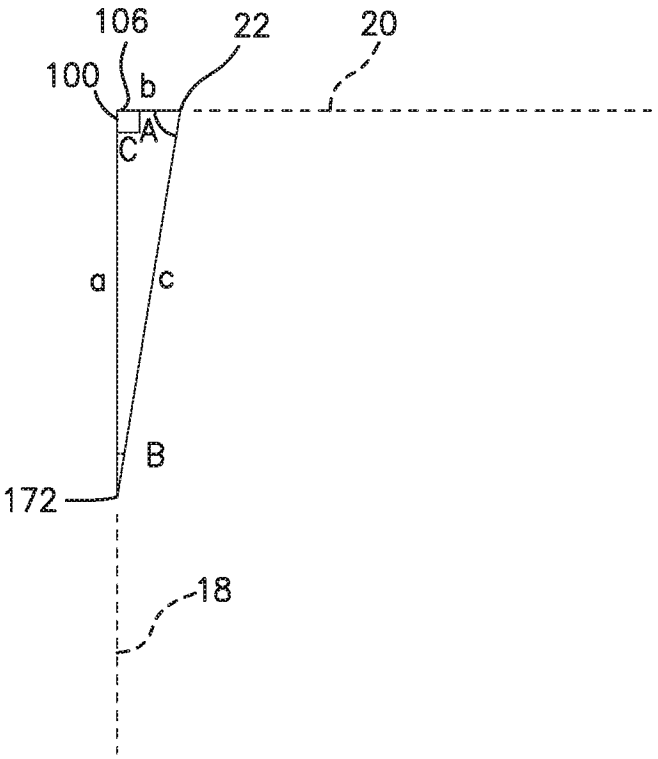
FIG. 6 is a conceptualized representation of interconnected elements of the swing resistance unit of FIG. 4 in the minimum counter-force position.
Figure 5:
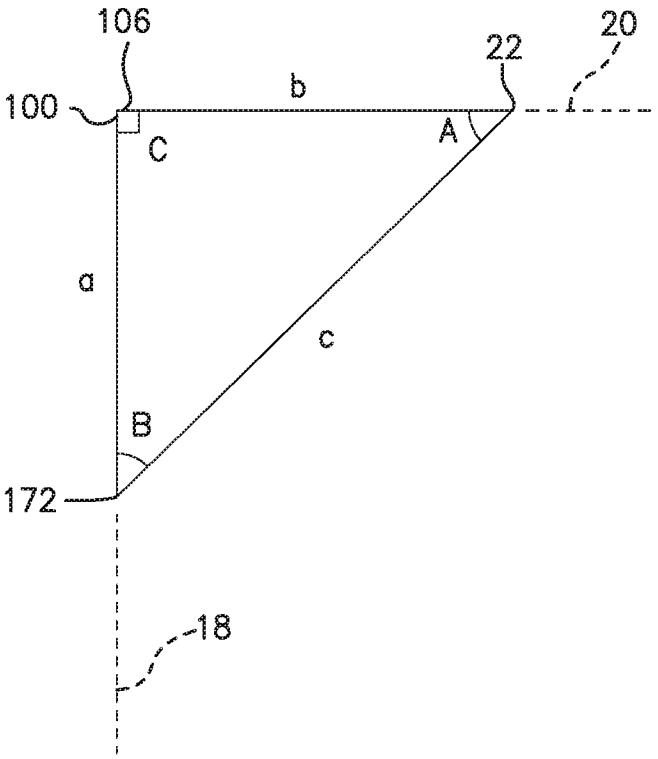
FIG. 5 is a conceptualized representation of interconnected elements of the swing resistance unit of FIG. 2 in the maximum counter-force position.
Figure 7:
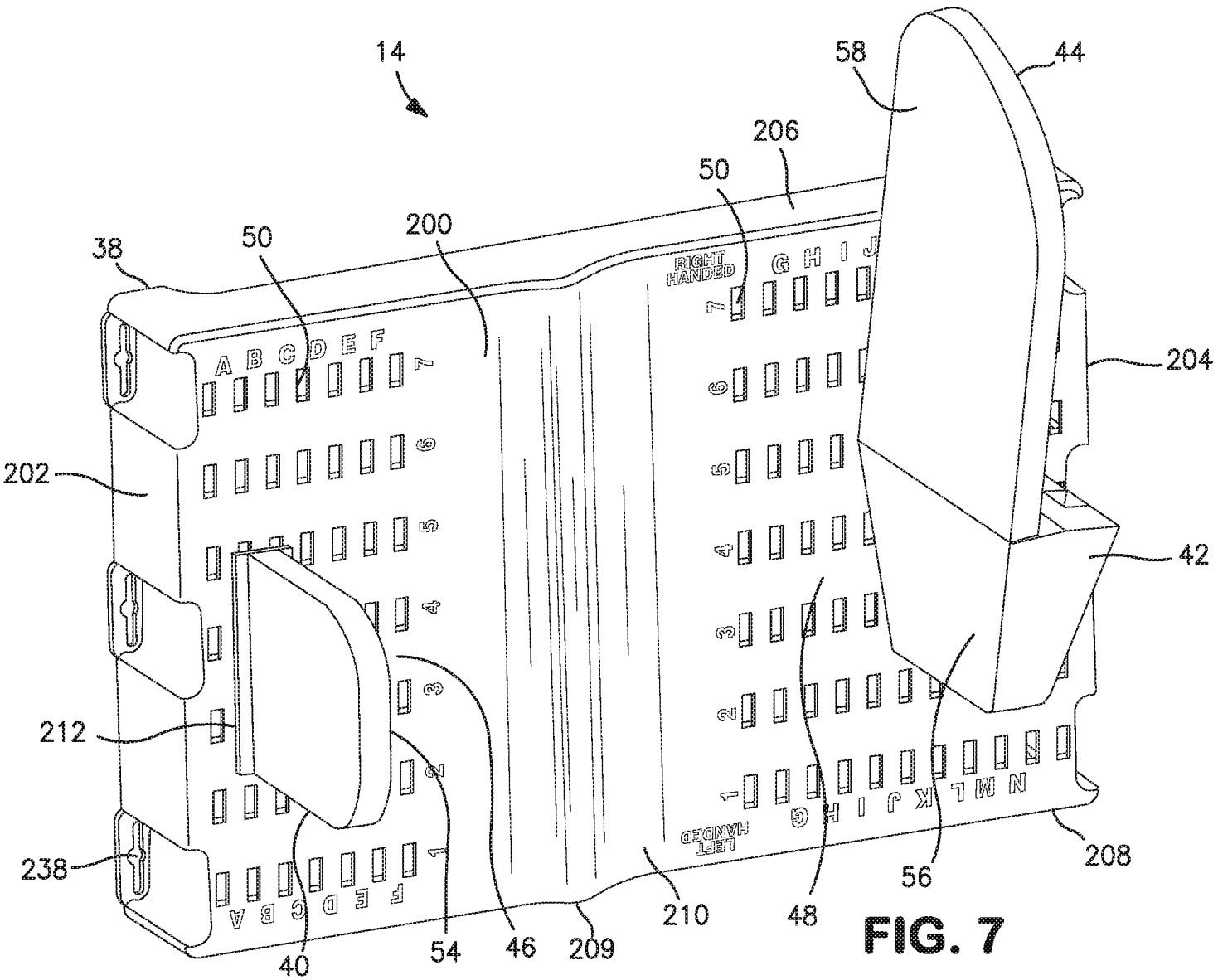
FIG. 7 is a perspective view of the body positioning unit of FIG. 1.
Figure 8:
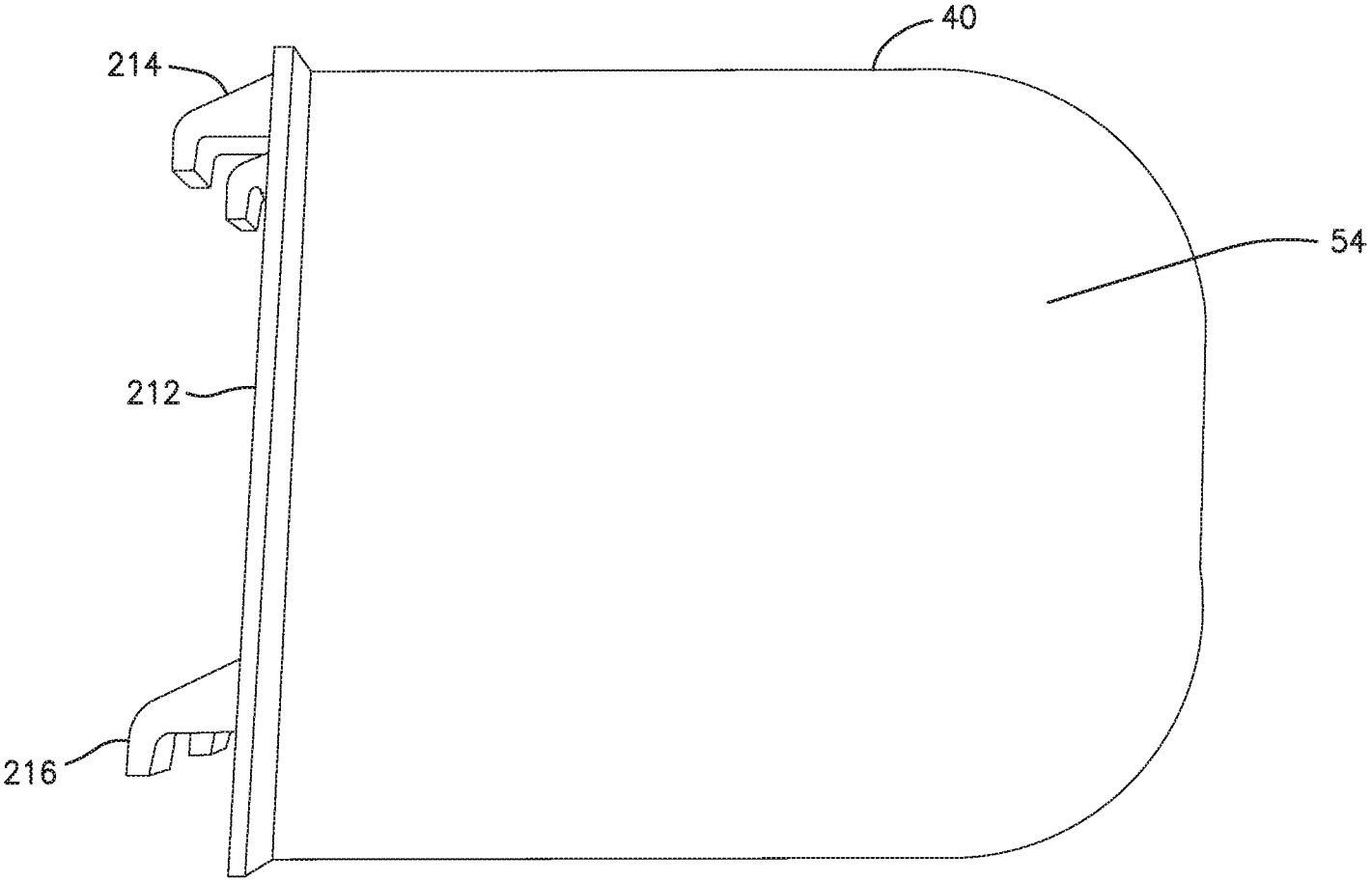
FIG. 8 is a perspective view of a trail hip limit included in the body positioning unit of FIG. 7.
Figure 9:
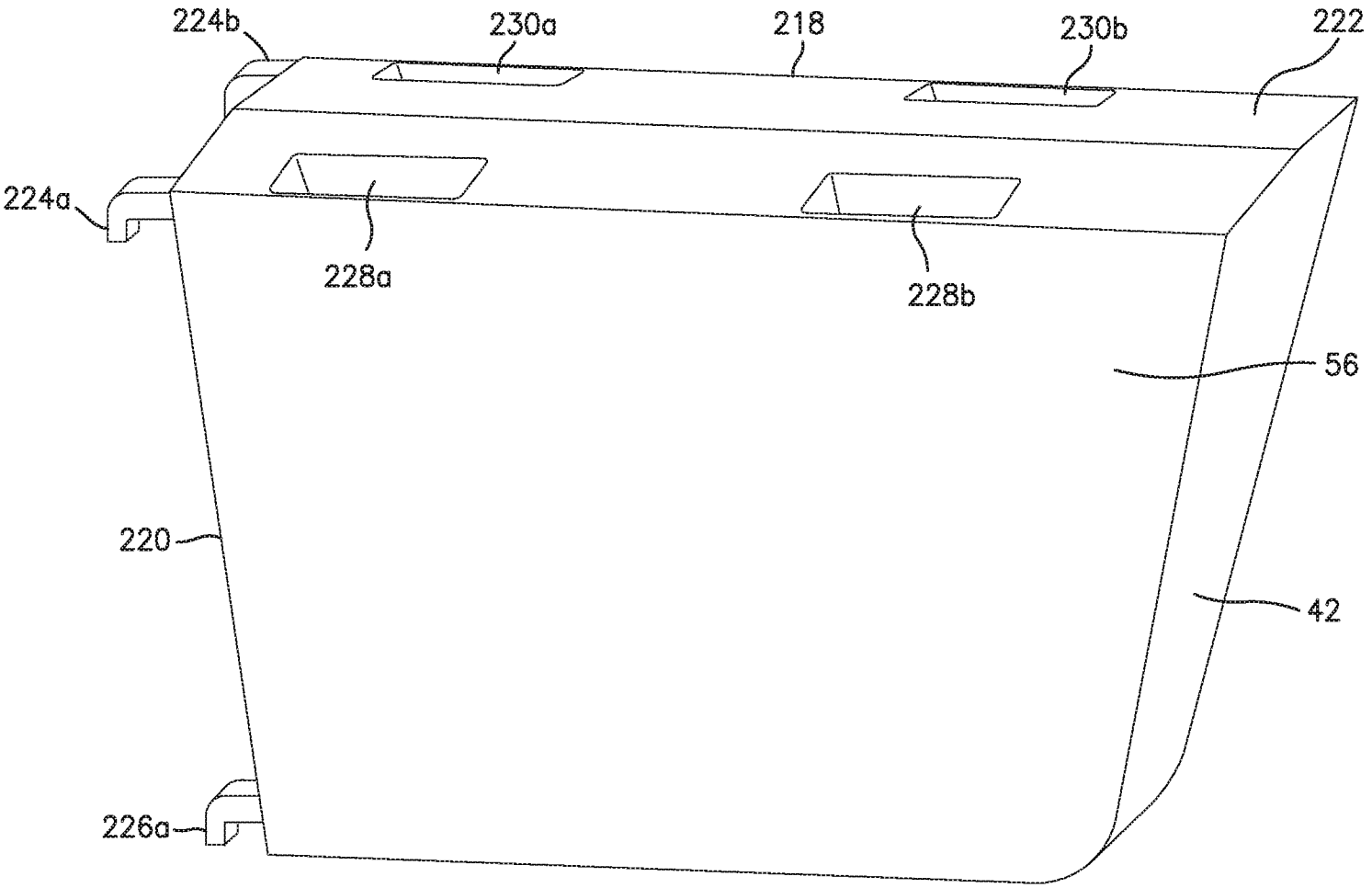
FIG. 9 is a perspective view of a lead hip limit included in the body positioning unit of FIG. 7.
Figure 10:
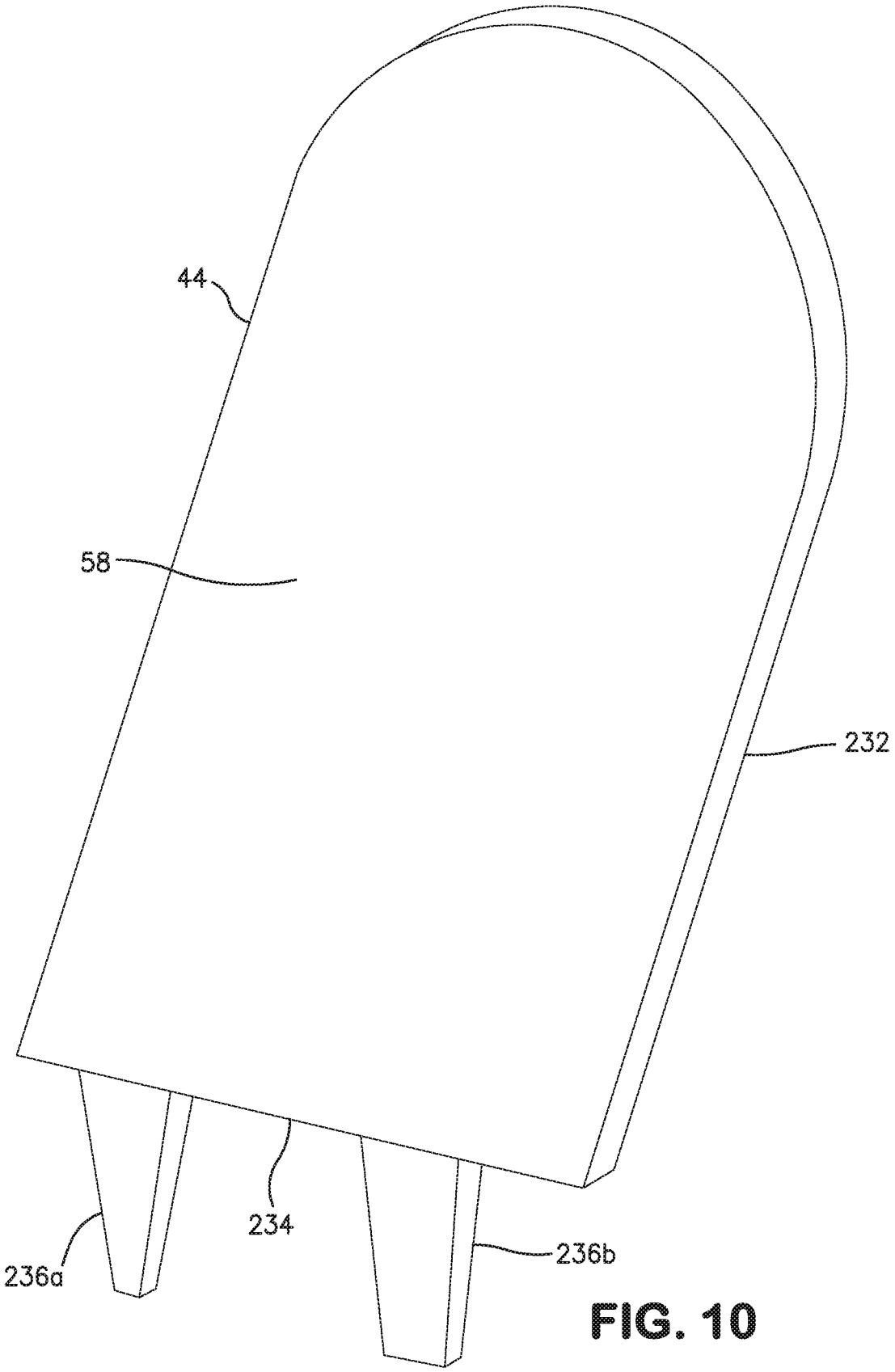
FIG. 10 is a perspective view of a static lead shoulder limit included in the body positioning unit of FIG. 7.

FIGS. 5 and 6 conceptually illustrate the varying overall length of the tensioner 26 during use of the swing training assembly 10 and further illustrate the correlation between the overall length of the tensioner 26 and the position of the shuttle 22 within the shuttle travel track 122. The tensioner 26, an upper portion of the mast 18, a portion of the shuttle travel track 122 on the proximal side of the shuttle 22 in combination approximate a right triangle. The portion of the mast 18 extending vertically downward from the upper end 100 of the mast 18 to the lower tensioner coupler 172 is a first side (a) of the right triangle, the portion of the shuttle travel track 122 extending horizontally from the proximal end of the shuttle travel track 122 to the shuttle 22 is a second side (b) of the right triangle and the overall length of the tensioner 24 extending diagonally between the first and second sides (a) and (b) is the hypotenuse (c) of the right triangle. The intersection of the second side (b) and hypotenuse (c) forms an angle A, the intersection of the first side (a) and hypotenuse (c) forms an angle B and the intersection of the first side (a) and second side (b) forms an angle C.

The length of the first side (a) remains constant during use of the swing training assembly 10, but the lengths of the second side (b) and hypotenuse (c) vary during use in correspondence with the horizontal position of the shuttle 22 in the shuttle travel track 122. Additionally, angles A and B vary during use while angle C remains constant at essentially 90°. It is noted that in practice, angle C can be greater than or less than 90°, e.g., as much as 15° either way. However, for the purpose of the present conceptualized representation, angle C is deemed essentially 90°. Displacing the shuttle 22 horizontally in the proximal direction within the shuttle travel track 122 during use shortens the second side (b), shortens the tensioner 24 (i.e., the hypotenuse (c)) and decreases angle B, while increasing angle A. Conversely, displacing the shuttle 22 horizontally in the distal direction within the shuttle travel track 122 lengthens the second side (b), lengthens the tensioner 24 and increases angle B, while decreasing angle A.

A preferred tensioner 24 of the swing training assembly 10 is a gas spring although the tensioner 24 may alternatively be a coil compression spring. The swing training assembly 10 may also be provided with multiple interchangeable tensioners. Each of the multiple tensioners is a compression piston having a chamber and rod as described above with respect to the tensioner 24 and each has a predetermined resistance to compression that is different from the others. For example, the multiple tensioners can comprise a set of three gas springs, i.e., a first gas spring having a relatively low resistance to compression, a second gas spring having a medium resistance to compression and a third gas spring having a high resistance to compression. In practice only one of the multiple gas springs is selected for use in the swing training assembly 10 at any given time and the remaining gas springs are set aside and not used. However, if an alternate resistance to compression is desired at some later time during use of the swing training assembly 10, the configuration of the upper and lower tensioner couplers 170, 172 enables a practitioner to change out the gas spring being used with one of the alternate set-aside gas springs having a more preferred resistance to compression.

The shuttle displacement line 26 has a first or proximal line end 186 and a second or distal line end 188. The proximal line end 186 is attached to the line anchor 110 and remains fixed, i.e., static, relative to the mast 18 and shuttle guide 20 during use of the swing training assembly 10. The distal line end 188 of the shuttle displacement line 26 is connected to the handle 28. In particular, the distal line end 188 has a clip 190 on it that is coupled with a connected end 192 of the handle 28 by means of a line coupler 194 that is rotatably attached to the connected end 192. The line coupler 194 is a swivel that enables the handle 28 to fully and freely rotate 360° about the longitudinal axis of the handle 28 relative to the shuttle displacement line 26, thereby obviating kinking of the shuttle displacement line 26 during use of the swing training assembly 10.

The handle 28 is constructed for golf swing training applications and is, therefore, modeled after and emulates the handle of a golf club. As such, the handle 28 is a rigid elongate cylindrical member having a slight taper along its length extending from an unconnected free end 196 of the handle 28 to the opposite connected end 192. The length of the handle 28 is typically on the order of about 20-25 cm which is sufficient to accommodate the combined width of both user's hands when clutching the handle 28 in a conventional golfer's grip, i.e., hand-above-hand, but not so long that the handle 28 impedes a proper golf swing during use of the swing training assembly 10. The exterior of the handle 28 is preferably constructed from a material that enhances the user's handhold on the handle 28, such as rubber, leather or a synthetic counterpart thereof. It is apparent to one of ordinary skill in the art that the handle 28 can be readily modified for alternate swing sport applications such as baseball, tennis or hockey by modeling the handle after the handle of a baseball bat, a tennis racquet or a hockey stick, respectively.

The shuttle displacement line 26 follows a line pathway that extends from the connected end 192 of the handle 28 into the hollow interior of the shuttle guide 22 and extends back and forth within the shuttle guide 22 in a zig zag pattern. The system of pulleys 126, 154, 158 that engage and direct the shuttle displacement line 26 at varying points along its length constitute a line guide. The line guide partitions the line pathway, and correspondingly the shuttle displacement line 26, into multiple line segments P, Q, R, S corresponding to the zigzag pattern of the shuttle displacement line 26.

Line segment P extends distally and substantially horizontally from the line anchor 110 to the proximal shuttle pulley 154. The proximal shuttle pulley 154 reverses the direction of the shuttle displacement line 26, thereby forming line segment Q which extends proximally and substantially horizontally, although along a slightly upward diagonal, from the proximal shuttle pulley 154 to the guide pulley 126. The guide pulley 126 again reverses the direction of the shuttle displacement line 26, thereby forming line segment R which extends distally and substantially horizontally, although along a slightly downward diagonal, from the guide pulley 126 to the lower shuttle pulley 158. The lower shuttle pulley 158 redirects the shuttle displacement line 26 downwardly and/or laterally away from it, thereby forming line segment S which extends from the lower shuttle pulley 158 to the clip 190 and line coupler 194 at the connected end 192 of the handle 28.

Each line segment P, Q, R of the shuttle displacement line 26 is positioned primarily internally within the shuttle travel track 122 and is coextensive and substantially horizontally aligned with the longitudinal axis of the shuttle travel track 122. The length of each line segment P, Q, R denoted $L_P$, $L_Q$, $L_R$, respectively, is equal to that of the others at all times during use of the swing training assembly 10 and is termed the "internal segment length" and denoted $L_{I\text{-}SEG}$. Thus, $L_{I\text{-}SEG}=L_P=L_Q=L_R$. $L_{I\text{-}SEG}$ also corresponds to the length of the second side (b) in FIGS. 5 and 6.

The total length of the shuttle displacement line 26 that is positioned primarily internally within the shuttle track 22 denoted $L_{I\text{-}TOT}$ is defined by the equation $L_{I\text{-}TOT}=3\times L_{I\text{-}SEG}=L_P+L_Q+L_R$. Notwithstanding the above, $L_{I\text{-}SEQ}$ (and correspondingly $L_{I\text{-}TOT}$) varies during use of the swing training assembly 10 as the swing training assembly 10 transitions between the maximum counter-force and minimum counter-force positions. Specifically, $L_{I\text{-}SEG}$ (and correspondingly $L_{I\text{-}TOT}$) varies as a function of the variable position of the shuttle 22 within the shuttle travel track 122, wherein the more proximal the position of the shuttle 22 within the shuttle travel track 122, the smaller $L_{I\text{-}SEG}$ (and correspondingly $L_{I\text{-}TOT}$) and the more distal the position of the shuttle 22 within the shuttle travel track 122, the greater $L_{I\text{-}SEQ}$ (and correspondingly $L_{I\text{-}TOT}$).

The remaining line segment S of the shuttle displacement line 26 is positioned entirely externally outside of the shuttle travel track 122 and is neither coextensive nor substantially horizontally aligned with the longitudinal axis of the shuttle travel track 122. The length of line segment S denoted $L_S$ is termed the "external segment length" and denoted $L_{E\text{-}SEG}$. $L_{E\text{-}SEG}$ is one and the same as the total length of the shuttle displacement line 26 that is positioned entirely externally outside of the shuttle track 22 denoted $L_{E\text{-}TOT}$. Thus, $L_{E\text{-}TOT}=L_{E\text{-}SEG}=L_S$. $L_{E\text{-}SEG}$ (and correspondingly $L_{E\text{-}TOT}$) varies during use of the swing training assembly 10 and also varies in relation to $L_{I\text{-}SEG}$ (and correspondingly $L_{I\text{-}TOT}$). The total length of the shuttle displacement line 26 when it is constructed from a non-stretchable material is termed the "total line length" and denoted $L_{TOT}$ which is constant at all times during use of the swing training assembly 10 and is defined by the equation $L_{TOT}=L_{I\text{-}TOT}+L_{E\text{-}TOT}$. $L_{E\text{-}SEG}$ (and correspondingly $L_{E\text{-}TOT}$) varies in an inverse relationship with $L_{I\text{-}SEG}$ (and correspondingly $L_{I\text{-}TOT}$). Thus, when $L_{I\text{-}SEG}$ increases, $L_{E\text{-}SEG}$ (and correspondingly $L_{E\text{-}TOT}$) decreases and when $L_{E\text{-}SEG}$ decreases (and correspondingly $L_{E\text{-}TOT}$), $L_{I\text{-}SEG}$ increases (and correspondingly $L_{I\text{-}TOT}$).

FIGS. 2 and 5 show the swing training assembly 10 and correspondingly the swing resistance unit 12 in the maximum counter-force position, wherein $L_{E\text{-}SEG}$ is at a minimum shorter length, $L_{I\text{-}SEG}$ is at a maximum longer length and the shuttle 22 is positioned near the distal guide end 108 of the shuttle guide 20 at a maximum distal position within the shuttle travel track 122. The maximum counter-force position of the swing training assembly 10 is its default position when no external forces are applied to the handle 28. FIGS. 4 and 6 show the swing training assembly 10 in the minimum counter-force position, wherein $L_{E\text{-}SEG}$ is at a maximum longer length, $L_{I\text{-}SEG}$ is at a minimum shorter length and the shuttle 22 is positioned near the proximal guide end 106 of the shuttle guide 20 at a maximum proximal position within the shuttle travel track 122.

Because the length of the second side (b) of the right triangle shown in FIGS. 5 and 6 (and correspondingly $L_{I\text{-}SEG}$) are directly related to the length of the tensioner 24 and because $L_{I\text{-}SEG}$ is inversely related to $L_{E\text{-}SEG}$, the length of the tensioner 24 is inversely related to $L_{E\text{-}SEG}$. Thus, the tensioner 24 is relatively longer and angle B is relatively greater when $L_{E\text{-}SEG}$ is relatively shorter and the tensioner 24 is relatively shorter and angle B is relatively smaller when $L_{E\text{-}SEG}$ is relatively longer.

In an alternate embodiment of the swing resistance unit not shown, the line guide of the swing training assembly is modified by excluding the intervening pulleys, i.e., the guide and proximal shuttle pulleys 154, 156, so that the lower shuttle pulley 158 is the only pulley in the line guide. In accordance with this embodiment, the shuttle displacement line 26 extends directly linearly within the shuttle travel track 122 from the line anchor 110 to the lower shuttle pulley 158 without any intervening re-direction of the shuttle displacement line 26. As such, the lower shuttle pulley 158 partitions the shuttle displacement line 26 into only two line segments, i.e., an external line segment that is essentially the same as line segment S shown in FIGS. 2 and 4 and an internal line segment extending between the line anchor 110 and the lower shuttle pulley 158. The lengths of the external and internal line segments in the swing training assembly of this embodiment exhibit essentially the same relation to one another as they do in the swing training assembly 10. In still other alternate embodiments the line guide is modified by excluding only one intervening pulley or by adding additional intervening pulleys to the two intervening pulleys already present in the line guide while retaining the lower shuttle pulley 158.

Body Positioning Unit

Further details of the body positioning unit 14 are described with continuing reference to FIG. 1 and additional reference to FIGS. 7-10. The posterior limit 38 of the body positioning unit 14 is an integral unitary structure having a substantially planar rectangular configuration that remains static during use. As such, the posterior limit 38 has a posterior front face 200 that is bounded on its four edges by vertically-oriented opposing posterior trail and lead edges 202, 204 and horizontally-oriented opposing posterior upper and lower edges 206, 208. The posterior front face 200 is vertically partitioned into the trail buttock contact surface 46 and lead buttock contact surface 48.

The trail and lead buttock contact surfaces 46, 48 are both planar, but the trail buttock contact surface 46 is raised relative to the lead buttock contact surface 48 so that the thickness of the posterior limit 38 is greater at the trail buttock contact surface 46 than at the lead buttock contact surface 48. The transition between the trail and lead buttock contact surfaces 46, 48 has a vertically-oriented alignment bump 209 on the distal side of the trail buttock contact surface 46 that is raised relative to the trail buttock contact surface 46 and a transition incline 210 that slopes downward in the distal direction from the raised alignment bump 209 to the depressed lead buttock contact surface 48. Although not shown, the posterior limit 38 alternatively has a uniform thickness and the trail and lead buttock contact surfaces 46, 48 form a single same continuous planar surface without the transition 209, 210 between them.

The trail hip limit mounting apertures 50 are arranged on the trail buttock contact surface 46 in a 7×7 trail hip limit mounting aperture array and the lead hip limit mounting apertures 52 are arranged on the lead buttock contact surface 48 in a 7×11 lead hip limit mounting aperture array. However, the sizes of the trail and lead hip limit mounting aperture arrays in the present embodiment are merely exemplary. Trail and lead buttock contact surfaces 46, 48 having alternate size trail and lead hip limit mounting aperture arrays fall within the scope of the present invention.

The trail hip limit 40 is an integral unitary structure having a relatively thin flat paddle-like configuration that remains static during use. The trail hip limit 40 is preferably constructed from a rigid molded plastic. The trail hip contact surface 54 of the trail hip limit 40 is the inside face of the trail hip limit 40 and is substantially planar. The trail hip limit 40 also has a trail hip limit rear edge 212 and opposing trail hip limit upper and lower mounting pegs 214, 216. The trail hip limit rear edge 212 is linear and vertically oriented. The trail hip limit rear edge 212 functions as a base for mounting the trail hip limit 40 on the trail buttock contact surface 46 of the posterior limit 38. Accordingly, the trail hip limit rear edge 212 is slightly wider than the thickness of the remainder of the trail hip limit 40. The trail hip limit upper mounting peg 214 is integral with the top of the trail hip limit rear edge 212 and extends rearwardly therefrom terminating at a hooked end. The trail hip limit lower mounting peg 216 is integral with the bottom of the trail hip limit rear edge 212 and similarly extends rearwardly therefrom terminating at a hooked end. The trail panel mounting pegs 214, 216 are sized and configured to be received within each and every one of the trail hip limit mounting apertures 50, thereby enabling separate selective and removable attachment of the trail hip limit 40 to the trail buttock contact surface 46.

The lead hip limit 42 has a wedge-shaped box-like configuration that remains static during use. The lead hip limit 42 is preferably constructed from a rigid molded plastic. The lead hip contact surface 56 of the lead hip limit 42 has a substantially planar configuration and is the inside face of the lead hip limit 42. The lead hip limit 42 also has a lead hip limit outside face 218, a lead hip limit rear face 220 and a lead hip limit upper face 222. The lead hip limit rear face 220 is likewise substantially planar and functions as a base for mounting the lead hip limit 42 on the lead buttock contact surface 48. The lead hip limit 42 has two lead hip limit upper mounting pegs 224*a*, 224*b*, two lead hip limit lower mounting pegs 226*a*, 226*b*, two lead hip limit inside mounting slots 228*a*, 228*b* and two lead hip limit outside mounting slots 230*a*, 230*b*. The lead hip limit upper mounting pegs 224*a*, 224*b* are integral with the opposing upper corners of the lead hip limit rear face 220 and extend rearwardly therefrom terminating at a hooked end. The lead hip limit lower mounting pegs 226*a*, 226*b* are integral with the opposing lower corners of the lead hip limit rear face 220 and similarly extend rearwardly therefrom terminating at a hooked end. The trail hip limit upper mounting peg 214 is integral with the top of the trail hip limit rear edge 212 and extends rearwardly therefrom terminating at a hooked end. The lead hip limit mounting pegs 224*a*, 224*b*, 226*a*, 226*b* are sized and configured to be received within each and every one of the lead hip limit mounting apertures 52, thereby enabling separate selective and removable attachment of the lead hip limit 42 to the lead buttock contact surface 48. The lead hip limit inside mounting slots 228*a*, 228*b* are formed in the lead hip limit upper face 222 toward the top inside edge of the lead hip limit 42 and the lead hip limit outside mounting slots 230*a*, 230*b* are formed in the lead hip limit upper face 222 toward the top outside edge of the lead hip limit 42.

The lead hip limit upper mounting pegs 224*a*, 224*b* are about 7.5 cm on center and the lead hip limit lower mounting pegs 226*a*, 226*b* are 2.5 cm on center. The configuration of the lead hip limit 42 and the spatial relation between the lead hip limit upper and lower mounting pegs 224*a*, 226*a* and lead hip limit mounting aperture array provides the lead hip contact surface 56 with a substantially vertical orientation when the swing training assembly 10 is in the set-up condition. The lead hip contact surface 56 of the present embodiment of the swing training assembly 10 is oriented about 8° to 10° from true vertical which results in the lead hip contact surface 56 having an inward cant toward the trail hip limit 40 as the lead hip contact surface 56 extends upward. As such, the term "substantially vertical orientation" as used in the present context refers to a lead hip contact surface having a true vertical orientation or having an orientation that deviates at most 15° from true vertical.

The lead shoulder limit 44 is an integral unitary structure having a relatively thin, substantially planar, paddle-like configuration that remains static during use. The lead shoulder limit 44 is preferably constructed from a rigid molded plastic. The lead shoulder contact surface 58 of the lead shoulder limit 44 is the inside face of the lead shoulder limit 44 and is substantially planar. The lead shoulder limit 44 also has a lead shoulder outside face 232, a lead shoulder lower edge 234 and opposing mounting pins 236*a*, 236*b*. The mounting pins 236*a*, 236*b* are integral with and extend downwardly from the opposing ends of the lead shoulder lower edge 234. The mounting pins 236*a*, 236*b* are sized and configured to be received within either pair of the lead hip mounting slots 228*a*, 228*b* or 230*a*, 230*b* formed in the lead hip upper face 222. The lead shoulder lower edge 234 is linear and horizontally oriented and functions as a base for mounting the lead shoulder limit 44 atop the similarly flat and horizontally oriented lead hip upper face 222 on the lead hip limit 42. When the swing training assembly 10 is the set-up condition, the lead shoulder contact surface 58 is continuous with the lead hip contact surface 56 and the lead shoulder contact surface 58 is preferably oriented about 8° to 10° from true vertical which results in the lead shoulder contact surface 58 having an inward cant toward the trail hip limit 40 as the lead shoulder contact surface 58 extends upward. In accordance with a preferred embodiment, the lead hip limit 42 and lead shoulder limit 44 are each provided with cooperative releasable locking couplers (not shown) that releasably lock the lead hip limit 42 and lead shoulder limit 44 together in place when the lead shoulder limit 44 is mounted atop the lead hip limit 42.

Swing Training Assembly Set-Up

The swing training assembly 10 is typically maintained in a compacted condition of non-use (not shown) while being stored or transported. The swing training assembly 10 is compacted by rotating the trail legs 60 of the assembly stand 16 together about the ends of the trail legs 60 that are attached to the trail leg coupler 62 so that the trail legs 60 assume a position parallel to one another with their opposing free ends abutting one another. The lead legs 64 are similarly rotated together about their ends attached to the lead leg coupler 66 so that the lead legs 64 assume a position parallel to one another with their opposing free ends abutting one another.

The swing training assembly 10 is transitioned from the compacted condition to the free-standing set-up condition of use shown in FIG. 1 by rotating the trail legs 60 in the opposite direction away from one another and similarly rotating the lead legs 64 away from one another. Once the trail and lead legs 60, 64 are sufficiently splayed apart, their set-up position is maintained by releasably locking the trail and lead legs 60, 64 to the trail and lead couplers 62, 66, respectively. The height of the swing resistance unit 12 on the assembly stand 16 is set by removing the stop 32 from height adjustment apertures 30*a*, 30*b* and slidably displacing the mast 18 vertically within the upper and lower mast retention rings 74, 76 until the shuttle guide 20 is positioned at a desired height off of the ground or floor that is correlated to the height of a user. With the shuttle guide 20 at the desired height, the user re-inserts the stop 32 into the pair of opposing height adjustment apertures 30*a*, 30*b* that are immediately adjacent to the opposing notches 78*a*, 78*b* in the upper mast retention ring 74. The notches 78*a*, 78*b* cradle the stop 32 when the stop 32 is inserted into the selected height adjustment apertures 30*a*, 30*b*. As a result, the stop 32, in cooperation with the height adjustment apertures 30*a*, 30*b* and the notches 78*a*, 78*b*, secures the position of the mast 18 and shuttle guide 20 and prevents both vertical displacement and rotation of the mast 18 and shuttle guide 20 relative to the assembly stand 16 during use of the swing training assembly 10.

The posterior limit 38 is selectively and releasably attached to at least one of the posterior limit support members 68, 70 using releasable attachment means on the backside of the posterior limit such as hooks, hangers or the like (not shown) that prevent displacement of the posterior limit 38 relative to the assembly stand 16 during use of the swing training assembly 10. The trail hip limit 40, lead hip limit 42 and lead shoulder limit 44 are in turn releasably mounted on the posterior limit 38 at positions that are correlated with the physical dimensions of the user. The appropriate positions for mounting the trail and lead hip limits on the posterior limit are dependent on the body dimensions of the user including primarily the user's height, the width of the user's hips and the width of the user's shoulders.

The user selectively and releasably mounts the trail hip limit 40 on the trail buttock contact surface 46 using the cooperative trail hip limit upper and lower mounting pegs 214, 216 and trail hip limit mounting apertures 50. In particular, the user selects specific trail hip limit mounting apertures 50 from the trail hip mounting aperture array that will result in an appropriately positioned trail hip limit 40 on the trail buttock contact surface 46 and inserts the trail hip limit upper and lower mounting pegs 214, 216 into the selected trail hip limit mounting apertures 50. Alpha-numeric reference characters are provided on the posterior front face 200 along the sides of the trail hip mounting aperture array to assist the user in identifying and remembering the selected trail hip limit mounting apertures 50. If the trail hip limit 40 is properly mounted, the user's trail hip should align with and contact the trail hip contact surface 54 when the user is at the address stage which begins the swing training method shown in FIGS. 11-16.

The user selectively and releasably mounts the lead hip limit 42 on the lead buttock contact surface 48 using the cooperative lead hip limit upper and lower mounting pegs 224*a*, 224*b*, 226*a*, 226*b* and lead hip limit mounting apertures 52. In particular, the user selects specific lead hip limit mounting apertures 52 from the lead hip limit mounting aperture array that will result in an appropriately positioned lead hip limit 42 on the lead buttock contact surface 48 and inserts the lead hip limit upper and lower mounting pegs 224*a*, 224*b*, 226*a*, 226*b* into the selected lead hip limit mounting apertures 52. Alpha-numeric reference characters are similarly provided on the posterior front face 200 along the sides of the lead hip mounting aperture array to assist the user in identifying and remembering the selected lead hip limit mounting apertures 52. The lead shoulder limit 44 is releasably mounted on the lead hip limit 42 by inserting the mounting pins 236*a*, 236*b* into the cooperative lead hip limit inside mounting slots 228*a*, 228*b*.

When the swing training assembly 10 is in the set-up condition, the height of the trail hip limit 40 is wholly contained within the height of the posterior limit 38, i.e., the upper edge of the trail hip limit 40 does not vertically extend above the posterior upper edge 206 and the lower edge of the trail hip limit 40 does not vertically extend below the posterior lower edge 208. As such, the height of the trail hip limit 40 is substantially less than that of the posterior limit 38 and is typically on the order of about 10-20 cm while the height of the posterior limit 38 is typically on the order of about 30-65 cm. The length of the trail hip limit 40, which is the distance that it horizontally extends forward from the trail buttock contact surface 46, is on the order of about 15-25 cm. The dimensions of the trail hip limit 40 are restricted so that the trail hip limit 40 does not interfere with movement of the user's arms during use of the swing training assembly 10.

The height of the lead hip limit 42 is essentially equal to that of the trail hip limit 40 so that the lead hip limit 42 is likewise wholly contained within the height of the posterior limit 38. The length of the lead hip limit 42 is also comparable to that of the trail hip limit 40. However, the combined height of the lead hip and shoulder limits 42, 44 is substantially greater than that of the posterior limit 38, i.e., typically on the order of about 65-90 cm, so that the upper edge of the lead shoulder limit 44 vertically extends a considerable distance above the posterior upper edge 206. The lead shoulder limit 44 also extends forward from the lead buttock contact surface 48 a considerably greater distance than the lead hip limit 42 extends horizontally forward. The length of the lead shoulder limit 44 is typically on the order of about 45-75 cm. It is apparent that the size of the lead shoulder limit 44 and its static configuration would interfere with proper movement of the user's arms if the user attempts a golf swing follow-through during use the training swing assembly 10. Accordingly, the present embodiment of the lead shoulder limit 44 restricts the user to only performing the address, takeaway, backswing and downswing stages of the golf swing during use of the swing training assembly 10.

When the set-up condition is achieved, the swing training assembly 10 is fully enabled for swing training. However, each time a different user utilizes the swing training assembly 10 for swing training, it is desirable to re-adjust the height of the swing resistance unit 12 and the relative positioning of the trail hip, lead hip and lead shoulder limits 40, 42, 44 on the posterior limit 38 in conformance with the new user's body dimensions before use.

The swing training assembly 10 is desirably designed to accommodate a wide range of body dimensions so that it has utility for a maximum number of users, e.g., all users within a 1.4 m to 2.0 m height range. The ability of the swing training assembly 10 to accommodate this wide range of users is attributable to the arrays of trail and lead hip limit mounting apertures 50, 52 and also to the fact that the trail and lead mounting pegs 214, 216, 224*a*, 224*b*, 226*a*, 226*b* are selectively removable from any given aperture 50, 52 and selectively insertable into any other alternate aperture 50, 52. Furthermore, although the swing training assembly 10 is shown and described herein as having utility for right-handed swings, the assembly 10 is readily adaptable to left-handed swings simply by rotating the posterior limit 180° about its mount on the assembly stand 16 and re-mounting the trail and lead hip limits at alternate positions on the posterior limit that are appropriate for a left-handed golf swing.

In an alternate embodiment of the swing training assembly that is not free-standing and less portable, the assembly stand 16 is omitted from the swing training assembly 10. The alternate swing training assembly is placed in a set-up condition by fixedly mounting the posterior limit 38 and mast 18 on a wall or some other fixed, vertically-oriented structure. Mounting the posterior limit 38 is effected by fastening the posterior limit 38 to the fixed structure by permanent or semi-permanent fasteners such as screws, nails or the like, that are inserted through fastener holes 238 provided along the edges of the posterior limit 38 into the fixed structure. Mounting the mast 18 is effected by means of wall-mounting brackets (not shown) that engage the upper and lower mast retention rings 74, 76. When the posterior limit 38 and mast 18 are properly mounted, they are stationarily positioned substantially parallel to the fixed structure.

Swing Training Method

An embodiment of a swing training method is described hereafter with reference to FIGS. 11-16. The present embodiment of the swing training method enables a user to simulate the performance of an actual golf swing and more particularly to simulate performance of the address, take-away, backswing and downswing stages of the golf swing using the swing training assembly 10. The term "simulated" is used herein to mean that the user does not use an actual golf club nor does the user actually strike a golf ball when performing the present embodiment of the swing training method. Instead the user performs a simulated swing with a simulated golf club and a phantom golf ball to mimic the movements of a golfer actually performing a golf swing during a round of golf. The present embodiment of the swing training method is specifically adapted for swing training in the long game component of a golf game where a golfer is using a full swing off the tee or fairway to inter alia desirably maximize shot distance. It is readily apparent to one of ordinary skill in the art that the swing training method can alternatively be adapted for swing training in the short game component of a golf game where a golfer is using a shortened swing near the green to inter alia desirably emphasize shortened shot distances.

Figure 11:
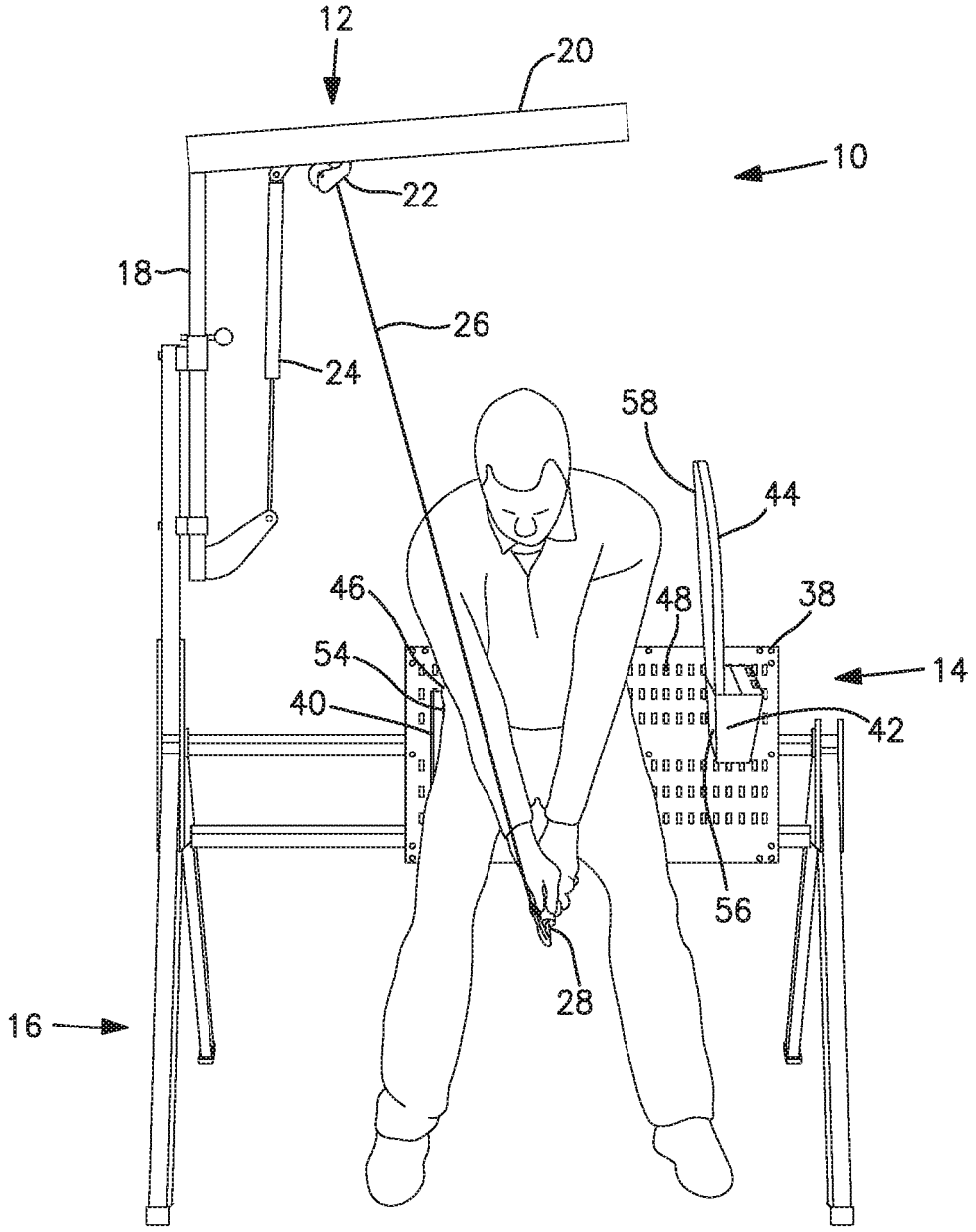
FIG. 11 is a front view of the swing training assembly of FIG. 1 being used to perform an embodiment of a swing training method, wherein the user and assembly are at the address stage of a simulated golf swing immediately before initiating the takeaway stage of the simulated golf swing.

Initiation of the present embodiment of the swing training method is shown with reference to FIG. 11, wherein the user is at the address stage of the simulated golf swing. The user properly aligns the buttocks with the posterior limit 38 by backing up against the posterior limit 38 with the tail bone engaging the alignment bump 209. The user's feet are firmly planted on the ground or floor in a normal good golf stance and posture and both hands of the user grip the handle 28 in a normal golf grip. The user positions the hands and handle 28, which functions as a simulated golf club, directly beneath the head with both arms straightened and extending downward. $L_{E\text{-}SEG}$ of the swing resistance unit 12 is essentially at a maximum, $L_{I\text{-}SEG}$ is essentially at a minimum and the shuttle 22 resides at its essentially most proximal position within in the shuttle travel track 122 near the guide pulley 126. This corresponds to the minimum counter-force position of the swing resistance unit 12 shown in FIGS. 4 and 6.

When the user is at the address stage, the trail buttock lightly contacts the trail buttock contact surface 46 and the trail hip lightly contacts the trail hip contact surface 54. The user maintains the lead buttock, lead hip and lead shoulder free from contact with the body positioning unit 14. In particular, the lead buttock is positioned away from the lead buttock contact surface 48 in the forward direction, the lead hip is positioned a distance on the order of about 7.5-10 cm away from the lead hip contact surface 56 and the lead shoulder is positioned a distance on the order of about 2.5-5 cm away from the lead shoulder contact surface 58. The terms "trail hip" and "lead hip" as used herein refer to the outside lateral faces of the trail and lead hips, respectively, which encompass the uppermost parts of the trail and lead upper legs, respectively. The term "lead shoulder" as used herein refers to the outside lateral face of the lead shoulder which encompasses the uppermost part of the lead upper arm.

Figure 12:
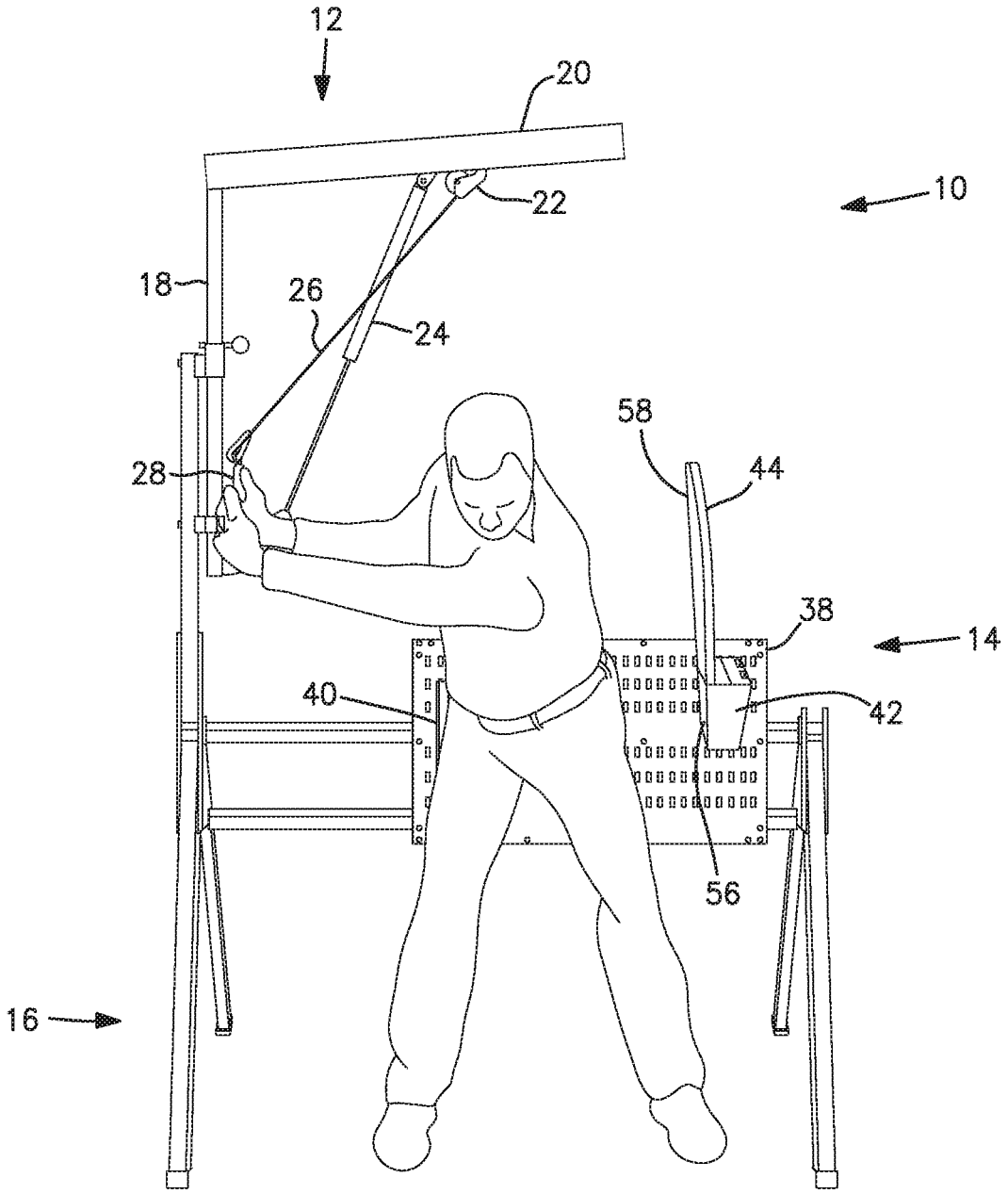
FIG. 12 is a front view of the swing training assembly of FIG. 1 being used to perform the embodiment of the swing training method of FIG. 11, but wherein the user and assembly are at the backswing stage of the simulated golf swing.

FIG. 12 shows the user at an intermediate point in the backswing stage following the address and takeaway stages. At this point in the backswing stage, the hands and handle 28 are positioned behind the user's trail hip, but below the trail shoulder. The trail arm is bent while the lead arm is straightened. The trail buttock, trail hip and trail shoulder are partially rotated backward in a clockwise direction, thereby maintaining the trail buttock and trail hip in contact with the trail buttock and trail hip contact surfaces 46, 54, respectively. The lead buttock, lead hip and lead shoulder are correspondingly partially rotated forward in the clockwise direction, thereby maintaining the lead buttock, lead hip and lead shoulder free from contact with the lead buttock, lead hip and lead shoulder contact surfaces 48, 56, 58, respectively. $L_{E\text{-}SEG}$ of the swing resistance unit 12 decreases throughout the backswing stage while $L_{I\text{-}SEG}$ increases. The shuttle 22 also moves horizontally within in the shuttle travel track 122 in the distal direction away from the guide pulley 126 throughout the backswing stage.

Figure 13:
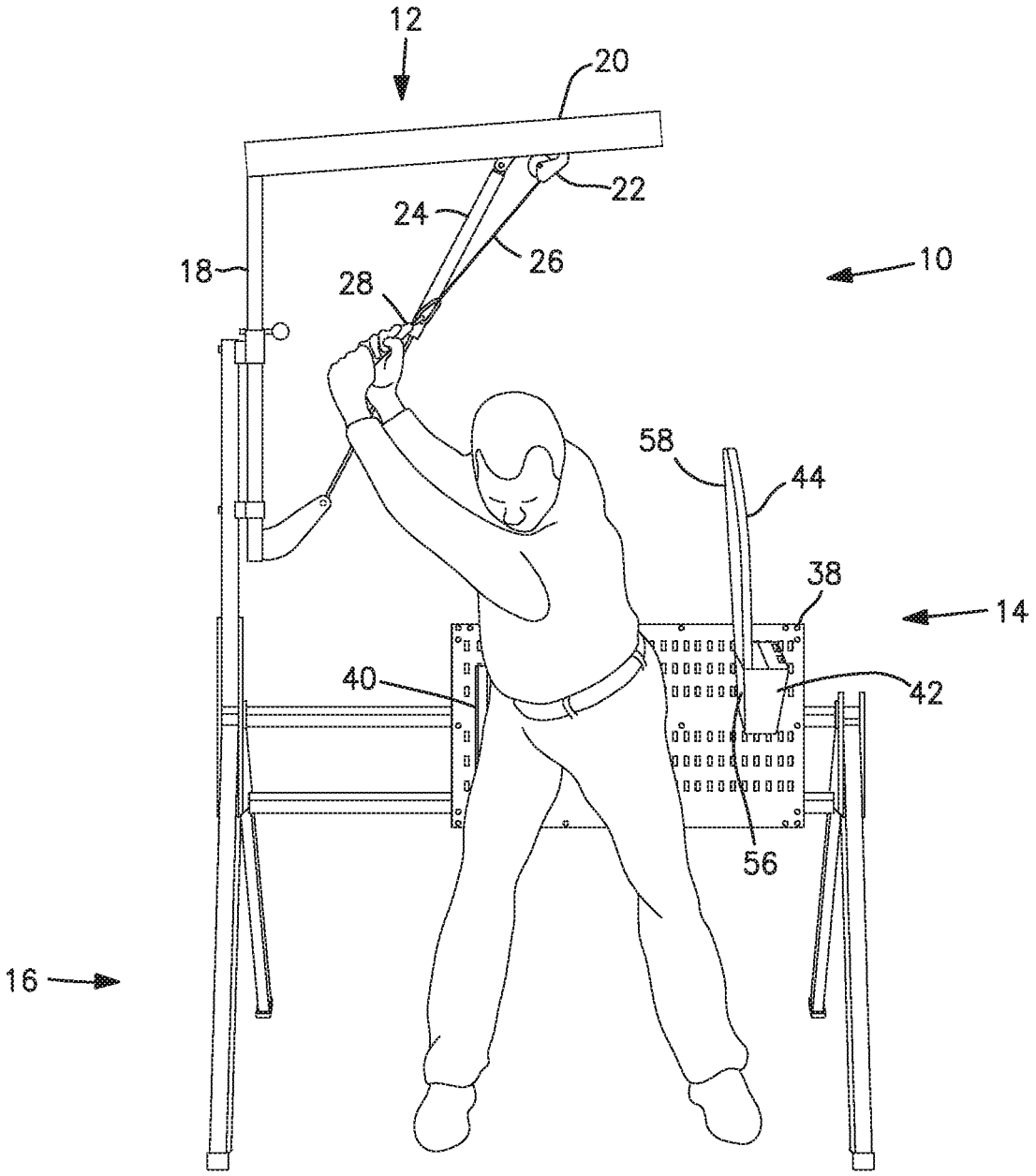
FIG. 13 is a front view of the swing training assembly of FIG. 1 being used to perform the embodiment of the swing training method of FIG. 11, but wherein the user and assembly are at the top of the backswing stage immediately before starting the downswing stage of the simulated golf swing.

FIG. 13 shows the user at the top (i.e., completion) of the backswing stage, wherein the hands and handle 28 are raised above the trail shoulder. The trail buttock, trail hip and trail shoulder are rotated backward and clockwise to essentially maximum points of backward rotation. The lead buttock, lead hip and lead shoulder are correspondingly rotated clockwise and forward to essentially maximum points of forward rotation. At the top of the backswing stage, the trail buttock and trail hip remain in contact with the trail buttock and trail hip contact surfaces 46, 54, respectively, and the lead buttock, lead hip and lead shoulder remain free from contact with the lead buttock, lead hip and lead shoulder contact surfaces 48, 56, 58, respectively. The user's head is centered approximately under the lower shuttle pulley 158. In sum, the user exhibits the following traits at the top of the backswing stage: a full shoulder turn in the clockwise direction, a straightened lead arm at maximum upward extension and a bent trail leg. The handle 28 is in essentially the same position in FIG. 2 as in FIG. 13 which corresponds to the maximum counter-force position of the swing resistance unit 12 shown in FIGS. 2 and 5, wherein $L_{E\text{-}SEG}$ is essentially at a minimum, $L_{I\text{-}SEG}$ is essentially at a maximum and the shuttle 22 resides at its essentially most distal position within in the shuttle travel track 122 away from the guide pulley 126.

After momentarily holding the top of the backswing stage, the user initiates the transition to the downswing stage by beginning to move the lead hip simultaneously both laterally toward the lead hip contact surface 56 and in a rotational, backward counter-clockwise direction toward the lead buttock contact surface 48, while maintaining the lead arm straightened and without allowing the knees to draw closer to one another. During this initial transition from backswing to downswing, the lead hip should contact the lead hip contact surface 56 and the lead buttock should contact the lead buttock contact surface 48 before the hands and handle 28 descend below the level of the user's waist. These actions exert an initial downswing pulling force on the handle 28, alternately termed a shuttle displacement force, that is sufficient to tension the shuttle displacement line 26, but at most only slightly horizontally displaces the shuttle 22 in the proximal direction within the shuttle travel track 122. Thus, $L_{E\text{-}SEG}$ increases only slightly (e.g., up to a few cm), if at all, at the initiation of the downswing stage from the minimum $L_{E\text{-}SEG}$ shown in FIGS. 2 and 5 and $L_{I\text{-}SEG}$ decreases only slightly, if at all, from the maximum $L_{I\text{-}SEG}$ shown in FIGS. 4 and 6. It is preferred that the hips provide the bulk, if not all, of the muscle power required to generate the initial downswing pulling force, while the shoulders and arms provide, at most, only a minimal amount of this power. In any case, the primary object of the initial downswing pulling force is to tension the shuttle displacement line 26 rather than to displace the shuttle 22.

Figure 14:
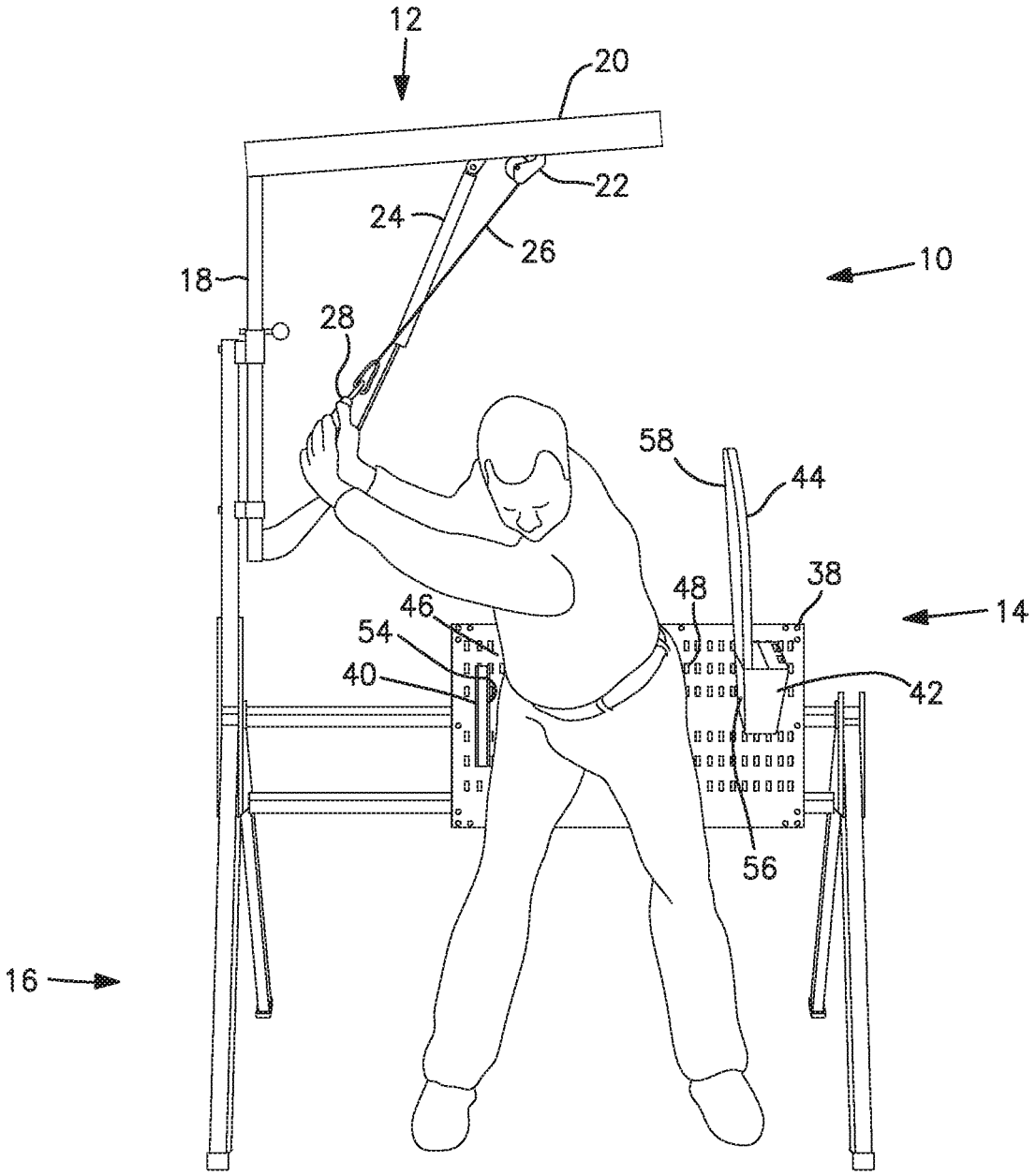
FIG. 14 is a front view of the swing training assembly of FIG. 1 being used to perform the embodiment of the swing training method of FIG. 11, but wherein the user and assembly are at an upper point in the downswing stage of the simulated golf swing.

FIG. 14 shows the user in an upper portion of the downswing stage, wherein the buttocks, hips and shoulders rotate in the counter-clockwise direction with the trail hip rotating in a forward counter-clockwise direction and the lead hip and shoulder rotating in a backward counter-clockwise direction while maintaining the lead arm straightened and without allowing the knees to draw closer to one another. This counter-clockwise rotation causes a slight distal movement of the lead knee in the desired direction of the golf shot and also causes a shift in the user's weight to the lead foot while the remaining weight on the trail foot rolls to the inside of the trail foot as the heel remains on the ground or floor. The trail hip rotates away from contact with the trail hip contact surface 54 and the lead hip rotates into very slight contact with the lead hip contact surface 56. The hands and handle 28 move in a downward and proximal direction along an arcuate path away from the shuttle travel track 122 to a horizontal position essentially level with the user's upper torso. The arcuate path of the hands and handle 28 exerts an upper downswing pulling force on the shuttle displacement line 26 that is sufficient to cause greater horizontal displacement of the shuttle 22 in the proximal direction within the shuttle travel track 122 relative to the initial downswing pulling force which correspondingly causes a more marked increase in $L_{E\text{-}SEG}$ and more marked decrease in $L_{I\text{-}SEG}$.

Figure 15:
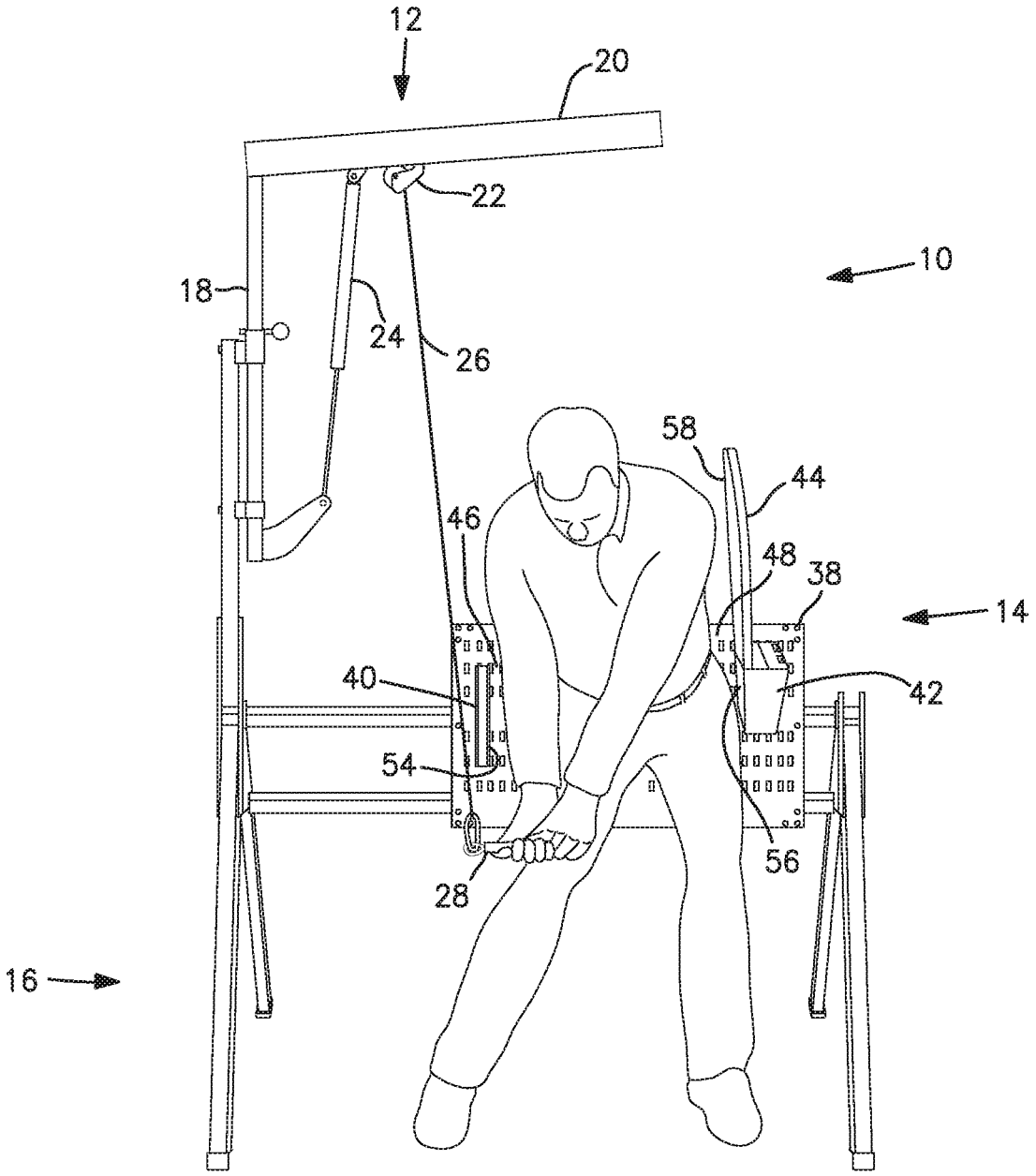
FIG. 15 is a front view of the swing training assembly of FIG. 1 being used to perform the embodiment of the swing training method of FIG. 11, but wherein the user and assembly are at a lower point in the downswing stage of the simulated golf swing.

FIG. 15 shows the user in a lower portion of the downswing stage, wherein the buttocks, hips and shoulders continue to rotate still further in the counter-clockwise direction while maintaining the lead arm straightened. This further counter-clockwise rotation automatically pulls the shoulders, arms and hands downward into a desired "slot position." In accordance with this position, the trail elbow is positioned directly in front of and even with the user's the trail hip, the lead buttock remains in full contact with the lead buttock contact surface 48, the trail buttock is drawn further away from the trail buttock contact surface 46 and the lead shoulder is drawn slightly short of or into only light contact with the lead shoulder contact surface 58. The user's hands and handle 28 exert a lower downswing pulling force on the shuttle displacement line 26. The horizontal force vector of the lower downswing pulling force is distally directed rather than proximally directed as in the case of the upper downswing pulling force. As the user progresses from the upper to lower portion of the downswing, $L_{E\text{-}SEG}$ continues to increase, $L_{I\text{-}SEG}$ continues to decrease and the shuttle 22 continues to slide horizontally in the shuttle travel track 122 in the proximal direction away from the distal guide end 108 of the shuttle guide 20 toward the guide pulley 126.

Figure 16:
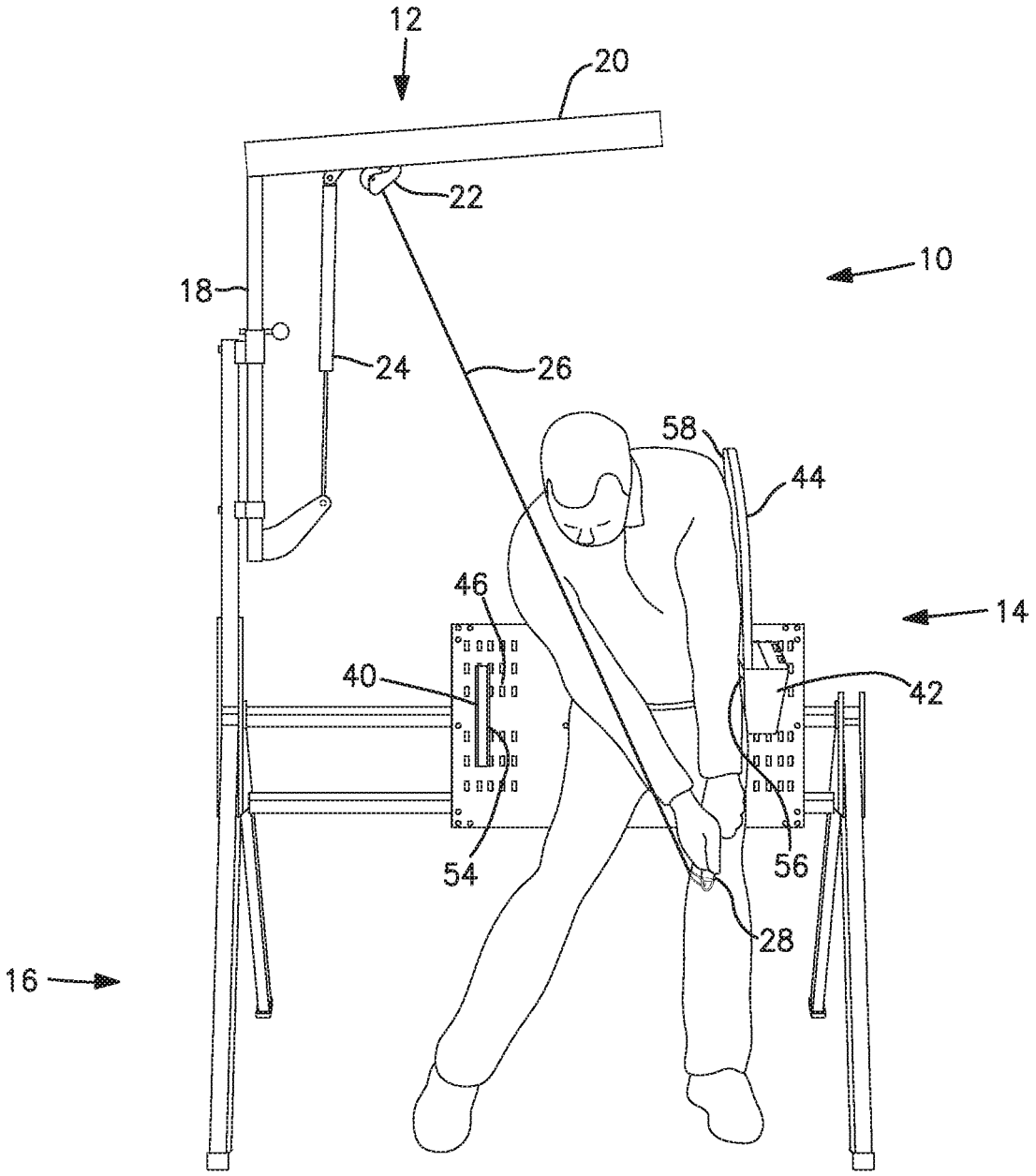
FIG. 16 is a front view of the swing training assembly of FIG. 1 being used to perform the embodiment of the swing training method of FIG. 11, but wherein the user and assembly are at the termination point for the method, which is at or near the bottom of the downswing stage of the simulated golf swing.

FIG. 16 shows the user at the termination point of the present embodiment of the swing training method, which is at or near the bottom of the downswing stage of the simulated golf swing. The user reaches the bottom of the downswing stage by continued counter-clockwise rotation of the buttocks, hips and shoulders, continued distal descent of the hands and handle 28 along the arcuate path and continued exertion of the lower downswing pulling force on the shuttle displacement line 26. The hands and handle 28 are positioned directly in front of the user and even with the lead leg. The user's weight is preferably about 75% on the lead foot and the knees are preferably separated at least as much as when the user is at the top of the backswing stage. The lead buttock is in contact with the lead buttock contact surface 48, the lead hip is in contact with the lead hip contact surface 56 and the lead shoulder is drawn slightly short of or into only light contact with the lead shoulder contact surface 58. The trail buttock and trail hip are simultaneously distanced away and free from contact with the trail buttock and trail hip contact surfaces 46, 54, respectively. The swing resistance unit 12 is in essentially the same minimum counter-force position at the bottom of the downswing as at the address stage, wherein $L_{E\text{-}SEG}$ is essentially at a maximum, $L_{I\text{-}SEG}$ is essentially at a minimum and the shuttle 22 resides at its essentially most proximal position within in the shuttle travel track 122 near the guide pulley 126. In an actual golf swing, the shoulders, arms and hands would continue to rotate counterclockwise past the present termination point immediately into the impact stage. However, the present embodiment of the swing training method terminates before the user performs the impact and follow-through stages of an actual golf swing.

It is preferable to perform multiple repetitions of the foregoing swing training method in each training session. For example, a training session can consist of 10 to 20 repetitions using a right-handed swing for the user's dominant right side and, after reconfiguring the swing training assembly 10 for a left-handed swing, 10 to 20 more repetitions using a left-handed swing for the user's non-dominant left side. Performing the swing training method using both sides of the user's body keeps the core muscles balanced. If the user's left side is dominant, the user simply reverses the above sequence in which the repetitions are performed. In any case, all body movements are preferably performed slowly by first-time users of the swing training assembly 10. The user can modestly increase the speed of the movements over time once the user has developed some proficiency in all elements of the swing training method.

In cases where the swing training assembly 10 is provided with multiple interchangeable tensioners, e.g., a set of three gas springs, it is preferable for first-time users to employ the low or medium compression-resistant gas spring in the swing training assembly 10 and only employ the high compression-resistant gas spring at the outset if the other gas springs compress far too easily for the user. The present swing training method is primarily intended to engrain a proper swing motion rather than to build muscles. Accordingly, the user need not maximize resistance to achieve the primary intended benefits of the present swing training method. Once a proper swing motion is ingrained in muscle memory over a prolonged period of swing training, the user can switch to the high compression-resistant gas spring to increase muscle strength and shoulder rotation if desired.

A primary function of the tensioner 24 in the practice of the present method is to provide a shuttle displacement counter-force in the opposite direction to the user's pulling force and in particular to the user's upper downswing pulling force described above with reference to FIG. 14. The upper downswing pulling force has two additive directional components, i.e., a downwardly-directed vertical force vector and a proximally-directed horizontal force vector. Conversely, the force that the tensioner 24 applies to the shuttle 22 has an upwardly-directed vertical force vector and a distally-directed horizontal force vector. However, the distally-directed horizontal force vector is the only directional force component that resists displacement of the shuttle 22 because the shuttle 22 is not vertically displaceable. Accordingly, the counter-force and the distally-directed horizontal force vector of the tensioner 24 are one and the same. The counter-force is preferably sufficient to inhibit the user from horizontally displacing the shuttle 22 too easily and/or too rapidly in the proximal direction within the shuttle travel track 122, but not so great that the user must physically strain against the counter-force to displace the shuttle 22.

The tensioner 24 advantageously applies the greatest counter-force to the shuttle 22 when the shuttle 22 is near its maximum distal position in the shuttle travel track 122 (i.e., when the user is initiating the downswing stage). This counter-force advantageously diminishes as the shuttle 22 approaches its maximum proximal position in the shuttle travel track 122 (i.e., when the user is at or near the bottom of the downswing stage). Thus, the counter-force (i.e., swing resistance force) is advantageously highest at the start of the simulated downswing stage and is lowest at the end of the simulated downswing stage.

The counter-force gradient is a result of the specific configuration of the swing resistance unit 12. When the tensioner 24 is at its maximum length as shown in FIGS. 5 and 13, the magnitude of angle B between the tensioner 24 and mast 18 is also at its greatest (i.e, about 45°) which maximizes the magnitude of the distally-directed horizontal force vector. The distally-directed horizontal force vector (i.e., counter-force) represents about half of the total that the tensioner 24 applies to the shuttle 22 and the upwardly-directed vertical force represents the other half. When the tensioner 24 is at its minimum length as shown in FIGS. 6, 11 and 16, the magnitude of angle B is at its smallest which minimizes the magnitude of the distally-directed horizontal force vector. Specifically, the upwardly-directed vertical force represents nearly all of the total force that the tensioner 24 applies to the shuttle 22 and the distally-directed horizontal force vector (i.e., counter-force) only represents the very small remainder.

Other advantageous features of the present embodiment of the swing training assembly 10 and of the swing training method are summarized below.

1) The positioning of the pulleys 126, 154, 158 engaging the shuttle displacement line 26 relative to one another enhances the rate at which $L_{E\text{-}SEG}$ increases relative to the distance that the shuttle 22 horizontally travels in the proximal direction when the user exerts a pulling force on the handle 28. Specifically, $L_{E\text{-}SEG}$ increases at a rate three times greater than the distance that the shuttle 22 travels. This enables the swing training assembly 10 to employ a relatively shorter shuttle travel track 122 than if fewer, or no, pulleys were employed in the swing training assembly.
2) Continuous displacement of the shuttle 22 in the proximal direction as the handle 28 follows an arcuate downward path during the downswing stage of the simulated golf swing maintains the line segment S of the shuttle displacement line 26 clear of the user's trailing shoulder so that the shuttle displacement line 26 does not interfere with performance of the simulated golf swing.
3) During an actual golf swing a user encounters inherent swing resistance due to the weight of the golf club as it follows a normal swing path. In the present swing training method, this inherent swing resistance is simulated by the counter-force of the swing resistance unit 12 when the shuttle 22 is displaced in the proximal direction during the downswing stage of the simulated golf swing.
4) Displacing the shuttle 22 in the proximal direction desirably shifts the counter-force in the proximal direction during the downswing stage of the simulated golf swing, thereby reducing the force the user requires to pull the handle 28 as the handle 28 progresses along its arcuate downward path. If the shuttle 22 and counter-force were not displaceable, but were permanently fixed at the distal end of the shuttle travel track 122, the user would require an unduly excessive force to pull the handle 28 along its arcuate downward path.

Another advantageous feature of the present embodiment of the swing training method is that the trail and lead buttock contact surfaces 46, 48, trail and lead hip contact surfaces 54, 56 and lead shoulder contact surface 58 of the body positioning unit 14 provide the user with real-time tactile information regarding the position of the user's trail and lead buttocks, trail and lead hips and lead shoulder, respectively. As such, the contact surfaces 46, 48, 54, 56, 58 function as positional reference points for the trail buttock, lead buttock, trail hip, lead hip and lead shoulder, respectively, and enable the user to confirm that these body parts are properly positioned in a proper spatial orientation when the user is in different stages of the golf swing. Although the contact surfaces 46, 48, 54, 56, 58 statically resist forces applied against them by the user, thereby limiting the range of movement for the user's trail and lead buttocks, trail and lead hips and lead shoulder, this is not their primary intended function as reference points. Therefore, to properly perform the present swing training method, the user need only lightly contact the contact surfaces 46, 48, 54, 56, 58 with the respective body parts. Any additional application of force to the contact surfaces 46, 48, 54, 56, 58 is unnecessary and an indication that the swing training method is not being performed properly.

Figure 17:
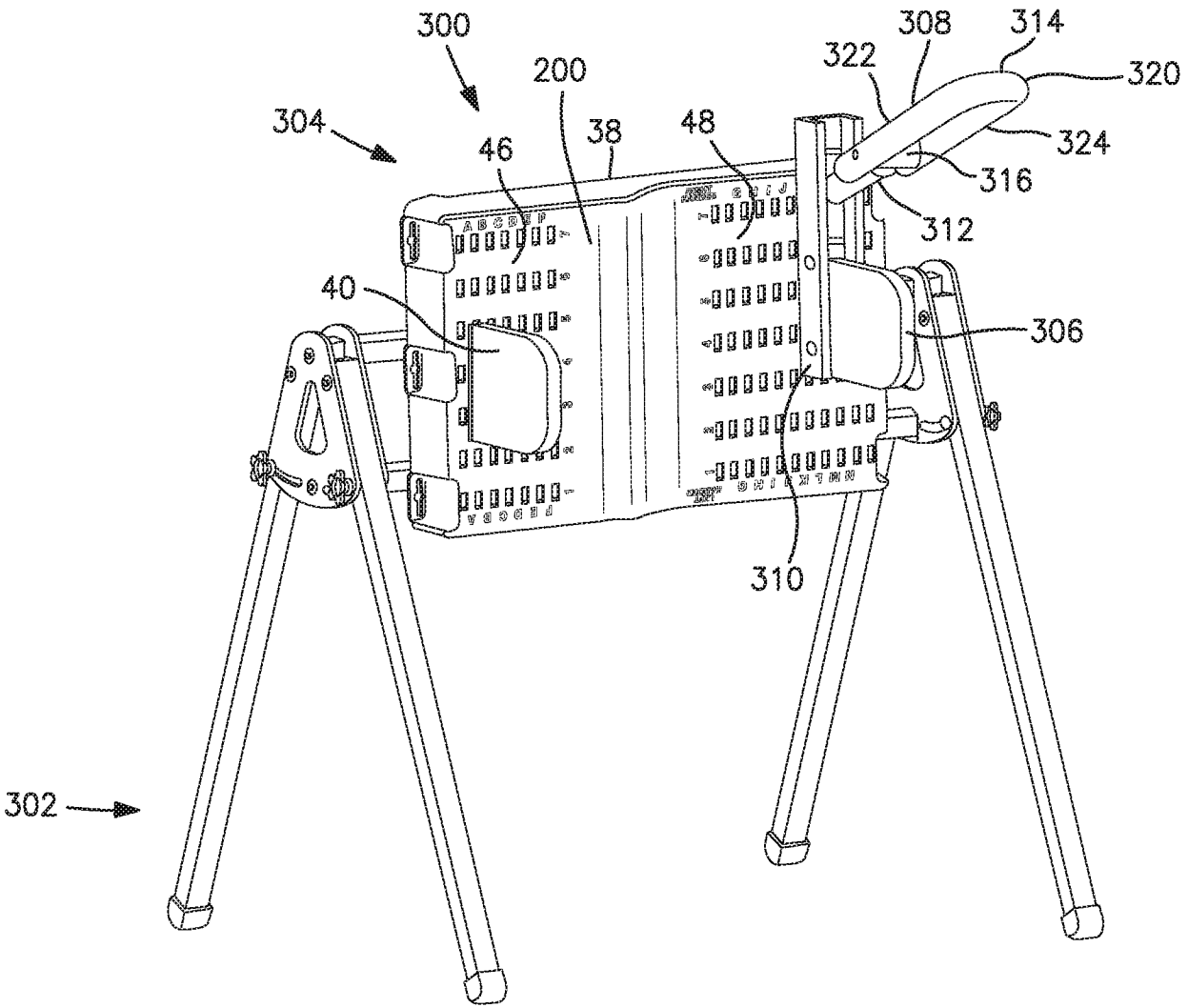
FIG. 17 is a perspective view of an alternate embodiment of a swing training assembly adapted for a practice golf swing using a golf club, wherein the swing resistance unit has been omitted from the swing training assembly and the static shoulder limit of the body positioning unit has been replaced by a dynamic shoulder limit shown at a starting position.
Figure 18:
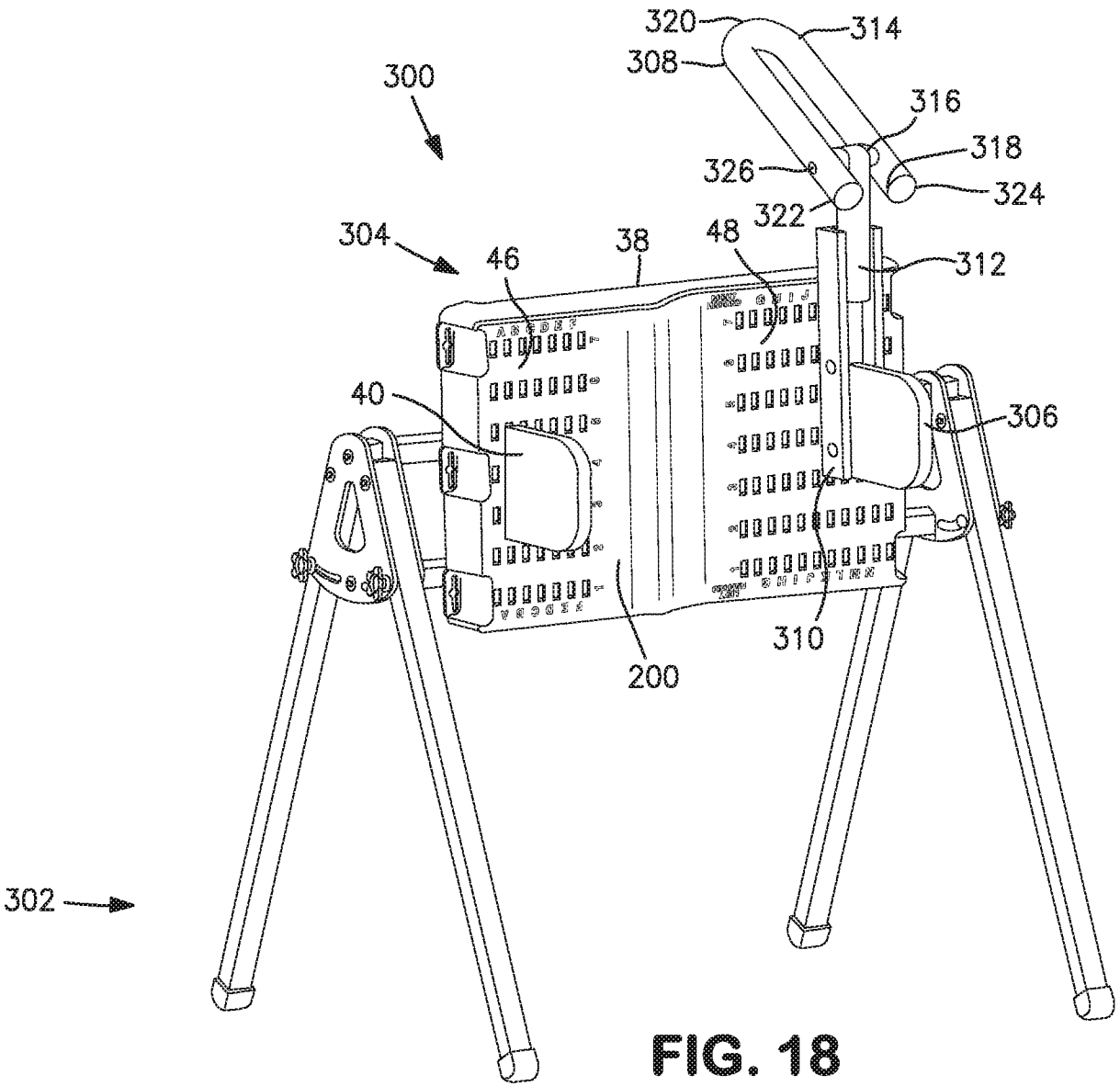
FIG. 18 is a perspective view of the swing training assembly of FIG. 17, wherein the dynamic shoulder limit is shown herein at a finished position.

Another embodiment of a swing training assembly generally designated 300 is shown with reference to FIGS. 17 and 18. The swing training assembly 300 enables a user to practice a golf swing in its entirety including the address, takeaway, backswing, downswing, impact and follow-through stages. FIG. 17 shows the swing training assembly 300 in a set-up condition that is ready for use, but is not actually in use. FIG. 18 shows the swing training assembly 300 in an end condition after a user has completed an actual golf swing.

The swing training assembly 300 includes an assembly stand 302 and a body positioning unit 304, but excludes the swing resistance unit 12 of the swing training assembly 10 and employs an actual golf club in its place. The assembly stand 302 is essentially the same as the assembly stand 16 except that it excludes the mast support member 72. The body positioning unit 304 includes the same posterior limit 38 and trail hip limit 40 as the swing training assembly 10, but substitutes a lead hip limit 306 and a dynamic lead shoulder limit 308 for the lead hip limit 42 and static lead shoulder limit 44 of the swing training assembly 10. The lead hip limit 306 has essentially the same dimensions and configuration as the trail hip limit 40 of the swing training assembly 10. The lead hip and lead shoulder limits 306, 308 are preferably constructed from a rigid plastic.

The lead hip limit 306 and dynamic lead shoulder limit 308 are coupled with one another by an elongate vertically-oriented posterior mount 310. The posterior mount 310 has upper and lower mounting pegs (not shown) extending from the backside of the posterior mount 310 that enable mounting the lead hip and lead shoulder limits 306, 308 on the lead buttock contact surface 48 of the posterior limit 38 using the array of lead hip mounting apertures 52 in substantially the same manner as described above with respect to the swing training assembly 10. The dynamic lead shoulder limit 308 has a rearward-positioned first rotatable member 312 and a forward-positioned second rotatable member 314 both of which preferably have a rigid tubular configuration. The terms "rearward" and "forward" refer to the relative positions of the first and second rotatable member members 312, 314 when the swing training assembly 300 is in the set-up condition shown in FIG. 17. The first and second rotatable members 312, 314 are each separately rotationally displaceable relative to the posterior mount 310, posterior limit 38 and trail and lead hip limits 40, 42 as well as relative to one another.

The first rotatable member 312 has a rearward end that is rotatably connected to the posterior mount 310 by a pivot (not shown) enabling the first rotatable member 312 to rotate in a counter-clockwise upward and rearward arc away from its initial position in the set-up condition which is substantially perpendicular relative to the posterior inside face 200 of the posterior limit 38. The term "substantially perpendicular" in this context encompasses the position of the first rotatable member 312 shown in FIG. 17 that is not precisely perpendicular to the posterior inside face 200, but extends forwardly as well as diagonally upward a few degrees from precisely perpendicular. The first rotatable member 312 also has a forward end on which a cross-member 316 is fixably mounted with a perpendicular orientation relative to the longitudinal axis of the first rotatable member 312. The cross-member 316 effects rotatable connection of the front end of the first rotatable member 312 with the second rotatable member 314.

The second rotatable member 314 has rearward and forward ends 318, 320 and a U-shape configuration formed by two prongs 322, 324 that diverge at the rearward end 318 and join together at the forward end 320. As such, the rearward end 318 is open and the forward end 320 is closed. The cross-member 316 of the first rotatable member 312 is positioned slightly forward of the rearward open end 318 and extends between the two prongs 322, 324. The cross-member 316 is rotatably attached to the prongs 322, 324 by an axle 326 that extends the length of the longitudinal axis of the cross-member 316, thereby enabling rotational displacement of the second rotatable member 314 about the axle 326 relative to the first rotatable member 312. Rotation of the second rotatable member 314 is in a counter-clockwise upward and rearward arc similar to rotation of the first rotatable member 312 about the pivot of the posterior mount 310.

When the second rotatable member 314 is in its initial position shown in FIG. 17, it is in linear alignment with the first rotatable member 312 also in its initial position, i.e. the second rotatable member 314 is substantially perpendicular relative to the posterior inside face 200 of the posterior limit 38. The first and second rotatable members 312, 314 have rotation stops (not shown) that prevent them from rotating clockwise in a further downward direction below their initial positions of alignment. The initial positions of the first and second rotatable members 312, 314 are alternatively termed downward arm-contactable rotation positions and are reached when the first and second rotatable members 312, 314 rotate downward under the force of gravity to the maximum degree permitted by the rotation stops.

The swing training assembly 300 transitions from the set-up condition shown in FIG. 17 to the end condition shown in FIG. 18 by transitioning the first and second rotatable members 312, 314 from their downward arm-contactable positions to upward cleared rotation positions. This transition is described in the context of a swing training method, wherein a user performs an actual golf swing to completion including the address, takeaway, backswing, downswing, impact and follow-through stages using the swing training assembly 300 and a golf club 328. The body positioning unit 304 of the swing training assembly 300 functions in substantially the same manner as the body positioning unit 14 of the swing training assembly 10 during performance of the address, takeaway, backswing and downswing stages. In particular, the dynamic lead shoulder limit 308 functions as a positional reference for the lead shoulder in substantially the same manner as the static lead shoulder limit 44 during these stages. The user's lead arm at most only lightly contacts the dynamic lead shoulder limit 308 which is insufficient to rotationally displace the first or second rotatable members 312, 314 from their initial positions as the golf swing progresses through completion of the downswing stage.

Figure 19:
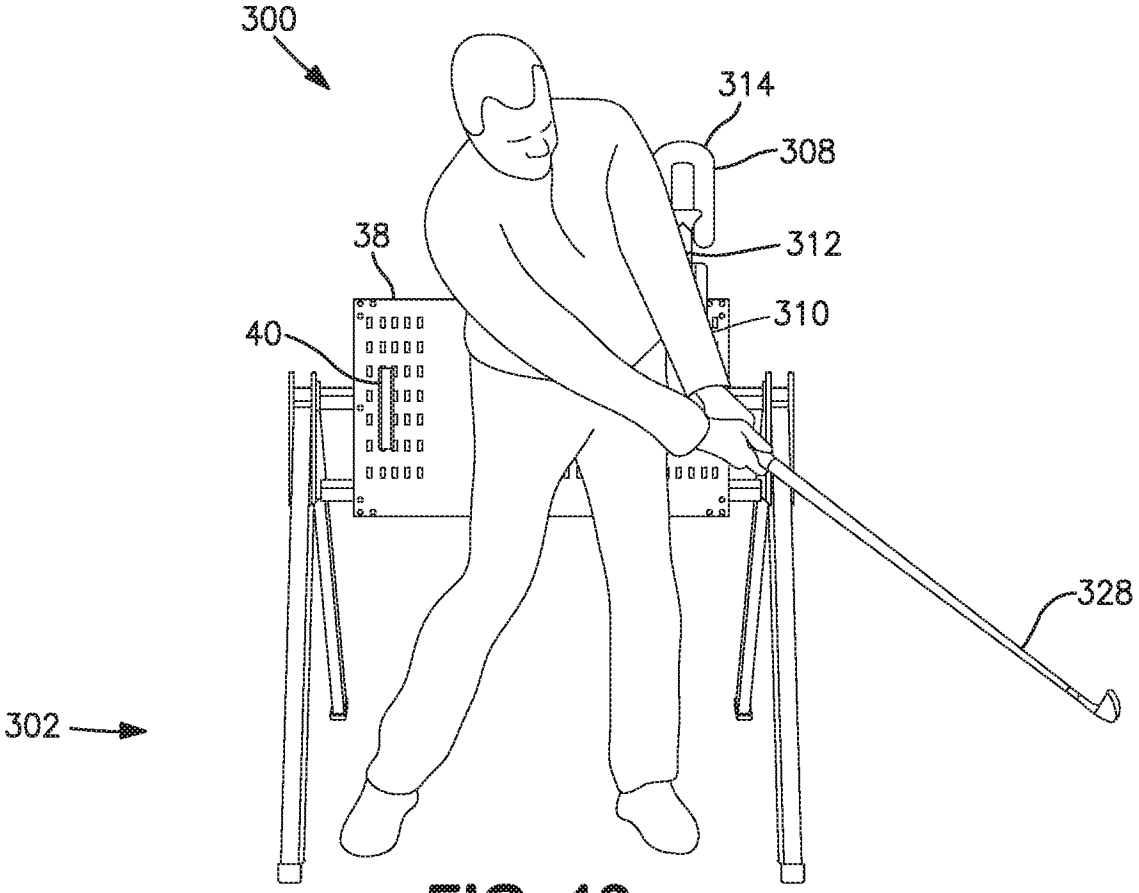
FIG. 19 is a front view of the swing training assembly of FIG. 17 being used to perform an alternate embodiment of a swing training method, wherein the user and assembly are at a lower point in the follow-through stage of the practice golf swing.
Figure 20:
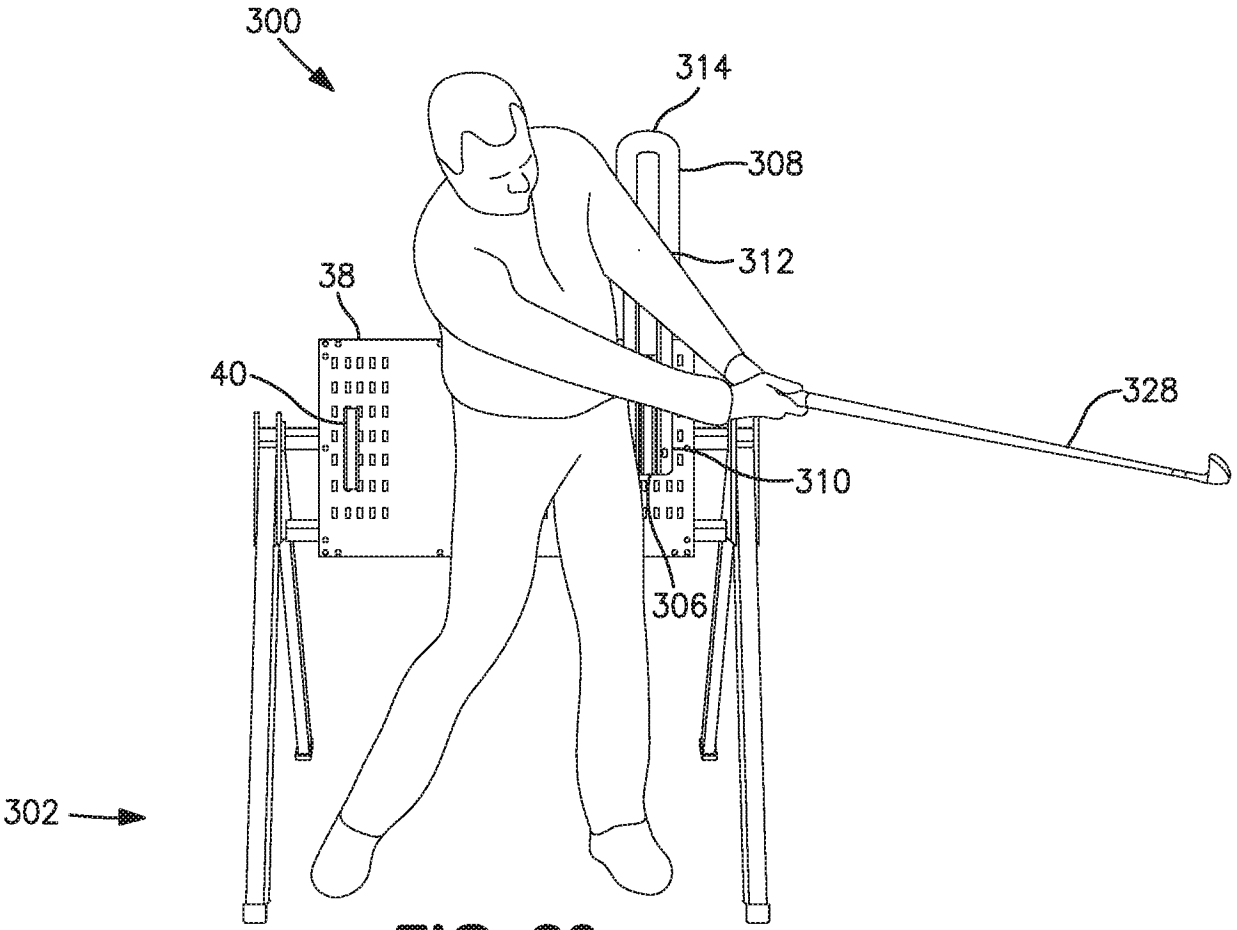
FIG. 20 is a front view of the swing training assembly of FIG. 17 being used to perform the embodiment of the swing training method of FIG. 19, but wherein the user and assembly are at a midpoint in the follow-through stage of the practice golf swing.
Figure 21:
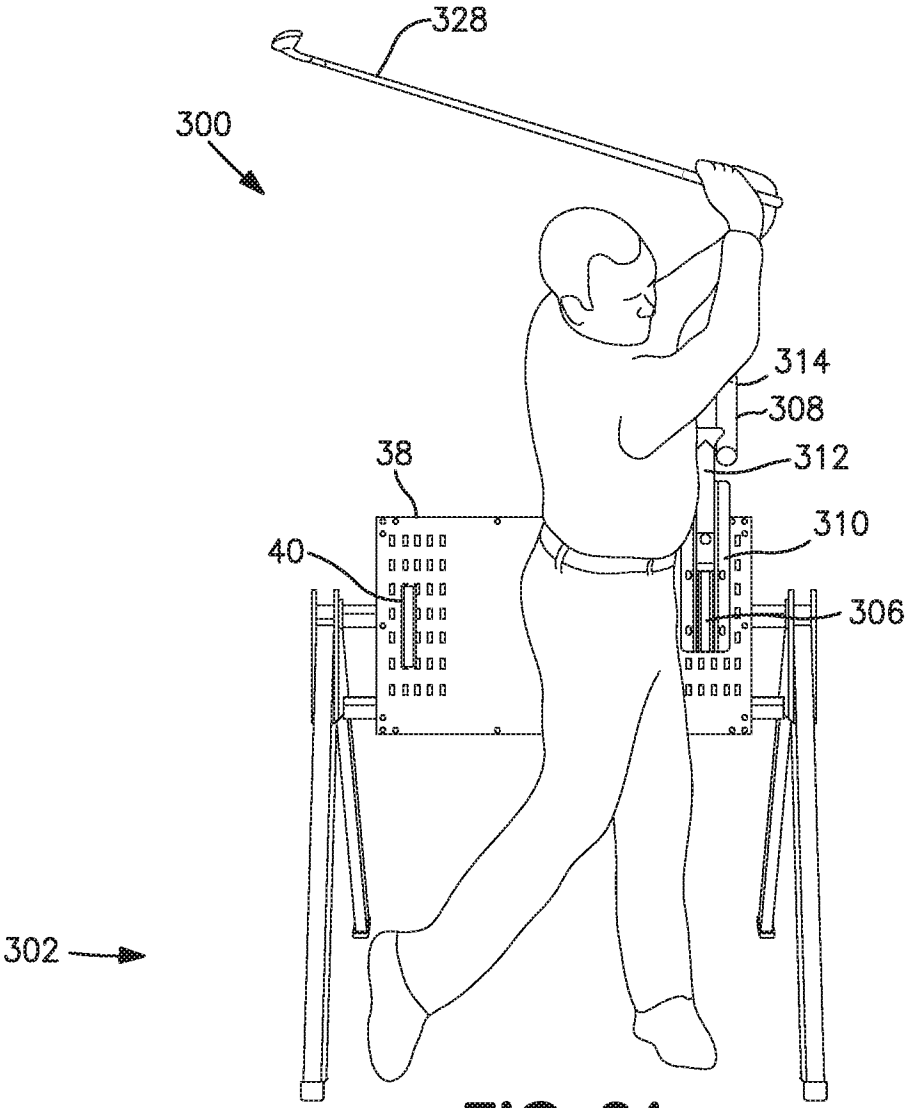
FIG. 21 is a front view of the swing training assembly of FIG. 17 being used to perform the embodiment of the swing training method of FIG. 19, but wherein the user and assembly are at or near the top of the follow-through stage which is the termination point of the practice golf swing.

Rotational displacement of the dynamic lead shoulder limit 308 preferably does not occur until the follow-through stage of the golf swing is performed as described hereafter with reference to FIGS. 19-21. FIG. 19 shows the user at a lower point in the follow-through stage of a practice golf swing after the user has completed impact stage. As the user rotates the hips, shoulders, arms and hands in the follow-through stage, the user's arms arc counter-clockwise upward and the lead arm initiates more forceful contact with the second rotatable member 314 and thereafter with the first rotatable member 312. As a result, the lead arm first rotationally displaces the second rotatable member 314 and then rotationally displaces the first rotatable member 312 in the upward counter-clockwise direction in correspondence with movement of the arms. It is noted that substantially the only resistance that the dynamic lead shoulder limit 308 offers to rotational displacement by the user is the relatively light weight of the tubular first and second rotatable members 312, 314. Therefore, the user need not exert undue physical strain to rotationally displace dynamic lead shoulder limit 308 that could undesirably alter the mechanics of the user's golf swing.

FIG. 20 shows the user continuing the practice golf swing to a midpoint in the follow-through stage. At this point there is still further counter-clockwise upward movement of the arms and corresponding rotational displacement of the first and second rotatable members 312, 314. FIG. 21 shows the user at or near the top of the follow-through stage. At this point the user's lead arm has fully rotated the first and second rotatable members 312, 314 all the way to their upward cleared rotation position which is the same position shown in FIG. 18. As a result the lead arm no longer contacts the dynamic lead shoulder limit 308 and the user is able to complete the follow-through without interference from the dynamic lead shoulder limit 308.

An advantageous feature of the swing training assembly 300 is that the dynamic lead shoulder limit 308 is rotationally displaceable about 90° to 120° in an upward counterclockwise direction from a horizontal position, but it is not linearly displaceable either distally or proximally in the horizontal lateral direction. This feature enables the dynamic lead shoulder limit 308 to impede undesirable lateral movement of the user's lead shoulder in the distal direction past the lateral position of the dynamic lead shoulder limit 308 during the downswing stage of a practice golf swing, yet the dynamic lead shoulder limit 44 freely permits desirable rotation of the lead shoulder in the upward and counterclockwise direction during the follow-through stage of a practice golf swing. In sum, the dynamic shoulder limit 308 functions in substantially the same manner as the static lead shoulder limit 44 in the swing training assembly 10 when the user is practicing the downswing stage of a golf swing with the swing training assembly 300. However, unlike the static lead shoulder limit 44, the rotatability of the dynamic lead shoulder limit 308 also enables the user to practice the follow-through stage of a golf swing with the swing training assembly 300. As a result, the swing training assembly 300 can be used to practice an actual golf swing in its entirety whereas the swing training assembly 10 is limited to swing training only as far as the bottom of the downswing.

Figure 22:
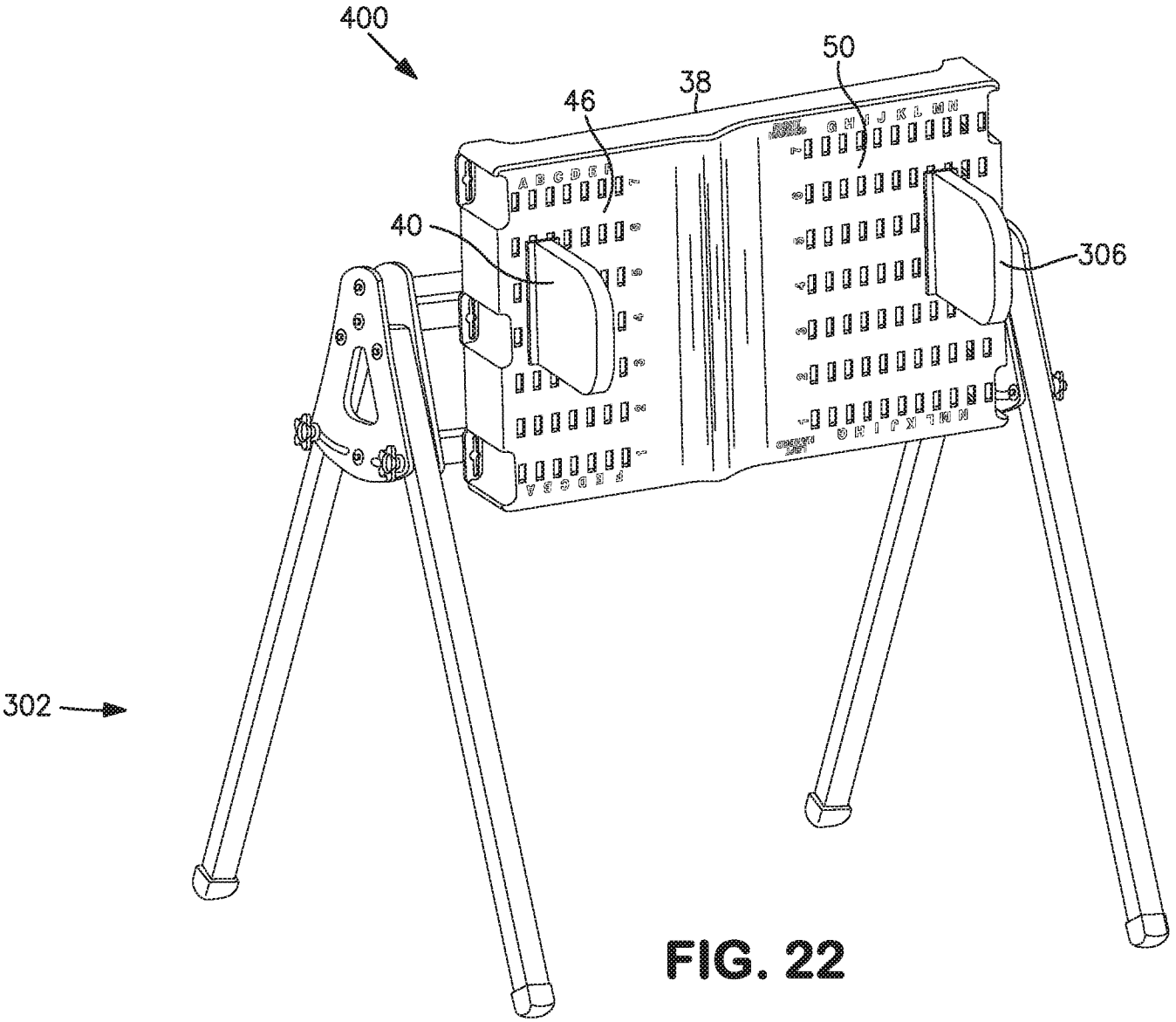
FIG. 22 is a perspective view of another alternate embodiment of a swing training assembly adapted for a practice golf swing using a golf club, wherein the swing resistance unit and shoulder limit of the body positioning unit have been omitted from the swing training assembly.

Another embodiment of a swing training assembly generally designated 400 is shown with reference to FIG. 22 that likewise enables a user to practice a full golf swing. The swing training assembly 400 is essentially the same as the swing training assembly 300 except that the swing training assembly 400 excludes the dynamic shoulder limit 308 and associated posterior mount 310 of the swing training assembly 300. Thus, the swing training assembly 400 has essentially the same assembly stand 302, posterior limit 38, trail hip limit 40 and lead hip limit 306 as the swing training assembly 300. It is noted that the lead hip limit 306 of the swing training assembly 400 includes the same type of mounting pegs as the trail hip limit mounting pegs 214, 216 which enable the lead hip limit 306 to be mounted on the lead buttock contact surface 48 of the posterior limit 38 in the absence of the posterior mount 310. The swing training assembly 400 is used in substantially the same manner as the swing training assembly 300 except that there is no lead shoulder limit to serve as a reference point for the user's lead shoulder during the practice golf swing.

An exemplary training swing session in accordance with the present teaching is described hereafter. The user performs about 10-20 simulated golf swings on the user's dominant side using the swing training assembly 10. The simulated golf swings are preferably performed at slow speed to concentrate on form. After completing the simulated golf swings, the user performs about 10-20 practice golf swings on the user's dominant side using the swing training assembly 300 or 400 and a golf club, but without a golf ball. The first 5-10 practice golf swings are performed at slow speed to concentrate on form followed by the remaining practice swings at normal speed. After completing the practice golf swings without a golf ball, the user performs about 10-20 practice golf swings on the user's dominant side using the swing training assembly 300 or 400 at normal speed while hitting a golf ball. The user can terminate the training session at this point or repeat it as many times as desired using the same sequence.

It is further within the scope of the present invention to modify the swing training assembly 10 so that it has utility for users who wish to use a single assembly to practice both simulated golf swings with the swing resistance unit 12 and actual full golf swings with a golf club in the absence of the swing resistance unit 12. In accordance with the present embodiment the swing training assembly 10 can be readily modified by including an extension device (not shown) such as a conventional expandable scissors wall mount or the like with the posterior limit 38 so that the swing training assembly 10 can be used as described above to practice a simulated golf swing or can be readily converted to an alternate configuration that can be used to practice a full golf swing with a golf club in the manner of the swing training assembly 300 or 400.

The extension device is preferably attached to the rear side of the posterior limit 38. When the swing resistance unit 12 and body positioning unit 14 are used in cooperation with one another to practice a simulated golf swing, the extension device is maintained in a compact folded configuration that does not interfere with the required spatial alignment of the swing resistance and body positioning units 12, 14 relative to one another. If the user alternatively desires to use the swing training assembly 10 to practice a full golf swing with a golf club in a manner that only uses a body positioning unit and omits the swing resistance unit 12, the user simply re-configures the extension device without disconnecting the body positioning unit 14 from the structure on which it is mounted. The user re-configures the extension device to extend the body positioning unit 14 a sufficient distance away from the swing resistance unit 12 (e.g., 0.5-1.5 m) to enable the user to perform practice swings using a golf club and the body positioning unit 14 without interference from the swing resistance unit 12. Typically the swing training assembly 10 is further modified by substituting the lead hip limit 306 and optionally the dynamic lead shoulder limit 308 for the lead hip limit 42 and static shoulder limit 44 before using this configuration. The same extension device can also return the body positioning unit 14 to its original set-up condition immediately adjacent to the swing resistance unit 12 after use.

The present embodiment of the swing training assembly enables the user to perform a comprehensive swing session such as the exemplary session described above using a single swing training assembly rather than multiple swing training assemblies 10 and 300 or 10 and 400. Furthermore, the present embodiment has universal utility for swing training assemblies mounted on stands as well as swing training assemblies mounted on walls or other fixed, vertically-oriented structures. One simply adapts the relevant extension device for whatever type of mounting for the swing training assembly is in use.

While the forgoing preferred embodiments of the invention have been described and shown, it is understood that alternatives and modifications within the purview of the ordinary artisan, such as those suggested and others, may be made thereto and fall within the scope of the invention.

We claim:

1. A body positioning apparatus for swing training comprising:

a posterior limit with an integral unitary construction that remains static during use and having a trail buttock contact surface and a lead buttock contact surface, wherein said trail and lead buttock contact surfaces are planar and adjacent to one another and said trail buttock contact surface is raised relative to said lead buttock contact surface such that said trail and lead buttock contact surfaces are parallel to one another;

a trail hip limit having a trail hip contact surface with a planar configuration adapted to engage a trail hip of a user, wherein said trail hip limit has a rigid construction and a paddle-like configuration and is selectively and releasably mounted on said trail buttock contact surface with said trail hip contact surface perpendicular to said trail buttock contact surface; and a lead hip limit having a lead hip contact surface with a planar configuration adapted to engage a lead hip of a user, wherein said lead hip limit has a rigid construction and a paddle-like configuration and is selectively and releasably mounted on said lead buttock contact surface with said lead hip contact surface perpendicular to said lead buttock contact surface.

2. The body positioning apparatus of claim 1 further comprising a lead shoulder limit abutting said lead buttock contact surface above said lead hip limit and having a lead shoulder contact surface with a planar configuration.

3. The body positioning apparatus of claim 2, wherein said lead shoulder limit is selectively and releasably mounted on said lead hip limit.

4. The body positioning apparatus of claim 1 further comprising a lead shoulder limit abutting said lead buttock contact surface above said lead hip limit, wherein lead shoulder limit is mounted on said posterior limit and has a rotatable member extending from said posterior limit in a substantially perpendicular orientation relative to said posterior limit when said swing training assembly is in a set-up condition and said rotatable member is rotationally displaceable from said substantially perpendicular orientation, but is laterally linearly fixed relative to said posterior limit during use of said swing training assembly.

5. The body positioning apparatus of claim 1 further comprising a stand, wherein said stand is free-standing, said posterior limit is mounted on said stand and said stand and said posterior limit remain static relative to one another during use.

6. The body positioning apparatus of claim 1, wherein said trail buttock contact surface has an array of trail hip limit mounting apertures formed therein and each trail hip limit mounting aperture is configured to selectively and releasably receive a trail hip limit mounting peg on said trail hip limit, thereby enabling selective and releasable mounting of said trail hip limit on said trail buttock contact surface.

7. The body positioning apparatus of claim 1, wherein said lead buttock contact surface has an array of lead hip limit mounting apertures formed therein and each lead hip limit mounting aperture is configured to selectively and releasably receive a lead hip limit mounting peg on said lead hip limit, thereby enabling selective and releasable mounting of said lead hip limit on said lead buttock contact surface.

8. A body positioning apparatus for swing training comprising:

a posterior limit with an integral unitary construction that remains static during use and having a posterior front face vertically partitioned into a trail buttock contact surface and a lead buttock contact surface horizontally adjacent to said trail buttock contact surface, wherein said trail and lead buttock contact surfaces are planar and said trail buttock contact surface is raised relative to said lead buttock contact surface such that said trail and lead buttock contact surfaces are parallel to one another; and a trail hip limit having a trail hip contact surface, wherein said trail hip limit has a rigid construction and a paddle-like configuration and is mounted on said trail buttock contact surface with said trail hip contact surface perpendicular to said trail buttock contact surface.

9. The body positioning apparatus of claim 8, wherein said posterior front face has a transition incline positioned between said trail and lead buttock contact surfaces sloping downward in a distal direction away from said trail buttock contact surface toward said lead buttock contact surface.

10. The body positioning apparatus of claim 9, wherein said posterior front face has a vertically-oriented alignment bump positioned between said trail buttock contact surface and said transition incline, and wherein said vertically-oriented alignment bump is raised relative to said trail buttock contact surface.

11. The body positioning apparatus of claim 8, wherein said trail hip contact surface has a planar configuration adapted to engage a trail hip of a user.

12. The body positioning apparatus of claim 8, wherein said trail hip limit is selectively and releasably mounted on said trail buttock contact surface.

13. A body positioning apparatus for swing training comprising:

a posterior limit with an integral unitary construction that remains static during use and having a posterior front face vertically partitioned into a trail buttock contact surface and a lead buttock contact surface horizontally adjacent to said trail buttock contact surface, wherein said trail and lead buttock contact surfaces are planar and said trail buttock contact surface is raised relative to said lead buttock contact surface such that said trail and lead buttock contact surfaces are parallel to one another; and a lead hip limit having a lead hip contact surface, wherein said lead hip limit has a rigid construction and a paddle-like configuration and is mounted on said lead buttock contact surface with said lead hip contact surface perpendicular to said lead buttock contact surface.

14. The body positioning apparatus of claim 13, wherein said lead hip contact surface has a planar configuration adapted to engage a lead hip of a user.

15. The body positioning apparatus of claim 13, wherein said lead hip limit is selectively and releasably mounted on said lead buttock contact surface.

16. A body positioning apparatus for swing training comprising:

a posterior limit having a posterior front face vertically partitioned into a trail buttock contact surface and a lead buttock contact surface horizontally adjacent to said trail buttock contact surface, wherein said trail and lead buttock contact surfaces are planar and said trail buttock contact surface is raised relative to said lead buttock contact surface, and wherein said posterior front face has transition with a vertically-oriented alignment bump raised relative to said trail buttock contact surface and positioned between said trail and lead buttock contact surfaces and a transition incline positioned between said vertically-oriented alignment bump and said lead buttock contact surface sloping downward in a distal direction away from said vertically-oriented alignment bump trail to said lead buttock contact surface;

a trail hip limit having a trail hip contact surface, wherein said trail hip limit is mounted on said trail buttock contact surface with said trail hip contact surface perpendicular to said trail buttock contact surface; and a lead hip limit having a lead hip contact surface, wherein said lead hip limit is mounted on said lead buttock contact surface with said lead hip contact surface perpendicular to said lead buttock contact surface.

17. A body positioning apparatus for swing training comprising:

a posterior limit having a posterior front face vertically partitioned into a trail buttock contact surface and a lead buttock contact surface horizontally adjacent to said trail buttock contact surface, wherein said trail and lead buttock contact surfaces are planar and said trail buttock contact surface is raised relative to said lead buttock contact surface, and wherein said posterior front face has a transition incline positioned between said trail and lead buttock contact surfaces sloping downward in a distal direction away from said trail buttock contact surface toward said lead buttock contact surface;

a trail hip limit having a trail hip contact surface with a planar configuration, wherein said trail buttock contact surface has an array of trail hip limit mounting apertures formed therein and each trail hip limit mounting aperture is configured to selectively and releasably receive a trail hip limit mounting peg on said trail hip limit, thereby enabling selective and releasable mounting of said trail hip limit on said trail buttock contact surface with said trail hip contact surface perpendicular to said trail buttock contact surface; and a lead hip limit having a lead hip contact surface with a planar configuration, wherein said lead buttock contact surface has an array of lead hip limit mounting apertures formed therein and each lead hip limit mounting aperture is configured to selectively and releasably receive a lead hip limit mounting peg on said lead hip limit, thereby enabling selective and releasable mounting of said lead hip limit on said lead buttock contact surface with said lead hip contact surface perpendicular to said lead buttock contact surface.

* * * * *